US007547289B2

(12) United States Patent
Branch

(10) Patent No.: US 7,547,289 B2
(45) Date of Patent: Jun. 16, 2009

(54) SHOULDER EXTENSION CONTROL DEVICE

(75) Inventor: Thomas P. Branch, Atlanta, GA (US)

(73) Assignee: ERMI Corporation, Decatur, GA (US)

( * ) Notice: Subject to any disclaimer, the term of this patent is extended or adjusted under 35 U.S.C. 154(b) by 451 days.

(21) Appl. No.: 10/318,988

(22) Filed: Dec. 13, 2002

(65) Prior Publication Data

US 2003/0130600 A1 Jul. 10, 2003

Related U.S. Application Data

(60) Provisional application No. 60/341,371, filed on Dec. 13, 2001.

(51) Int. Cl.
*A61H 1/02* (2006.01)

(52) U.S. Cl. ..... 601/5; 601/26; 601/33

(58) Field of Classification Search ..... 601/5, 601/23, 24, 26, 33, 40, 34, 35
See application file for complete search history.

(56) References Cited

U.S. PATENT DOCUMENTS

| | | | | | |
|---|---|---|---|---|---|
| 2,427,053 | A | * | 9/1947 | Hampton | 601/98 |
| 3,780,728 | A | | 12/1973 | Stader | |
| 3,892,230 | A | * | 7/1975 | Baker et al. | 601/33 |
| 3,906,924 | A | | 9/1975 | Lumb, Jr. et al. | |
| 3,937,215 | A | | 2/1976 | Bartholme | |
| 4,146,021 | A | | 3/1979 | Brosseau et al. | |
| 4,291,715 | A | | 9/1981 | Monte | |
| 4,370,976 | A | | 2/1983 | Wanchik et al. | |
| 4,599,996 | A | | 7/1986 | Seith et al. | |
| 4,669,451 | A | * | 6/1987 | Blauth et al. | 601/33 |
| 4,867,140 | A | | 9/1989 | Hovis et al. | |
| 4,960,115 | A | | 10/1990 | Ranciato | |
| 5,020,515 | A | | 6/1991 | Mann et al. | |
| 5,033,457 | A | | 7/1991 | Bonutti | |
| 5,117,814 | A | | 6/1992 | Luttrell et al. | |
| 5,163,451 | A | * | 11/1992 | Grellas | 128/898 |
| 5,179,939 | A | * | 1/1993 | Donovan et al. | 601/33 |
| 5,219,324 | A | | 6/1993 | Hall | |
| 5,230,335 | A | | 7/1993 | Johnson, Jr. et al. | |
| 5,242,378 | A | | 9/1993 | Baker | |
| 5,313,971 | A | | 5/1994 | Upshaw | |
| 5,417,643 | A | * | 5/1995 | Taylor | 601/33 |
| 5,423,333 | A | | 6/1995 | Jensen et al. | |
| 5,425,567 | A | | 6/1995 | Albecker, III | |
| 5,445,602 | A | | 8/1995 | Grim et al. | |
| 5,514,081 | A | | 5/1996 | Mann | |
| 5,514,155 | A | | 5/1996 | Daneshvar | |
| 5,916,186 | A | | 6/1999 | Turto et al. | |
| 5,938,573 | A | * | 8/1999 | Davies et al. | 482/131 |
| 5,950,628 | A | | 9/1999 | Dunfee | |
| 6,007,500 | A | * | 12/1999 | Quintinskie, Jr. | 601/5 |
| 6,113,562 | A | * | 9/2000 | Bonutti et al. | 602/20 |
| 6,179,800 | B1 | | 1/2001 | Torrens | |

(Continued)

FOREIGN PATENT DOCUMENTS

| | | |
|---|---|---|
| DE | 92 17 225.3 | 4/1993 |

(Continued)

*Primary Examiner*—Danton DeMille
(74) *Attorney, Agent, or Firm*—Alston & Bird LLP

(57) ABSTRACT

Methods and apparatuses for providing range of motion control devices, and particularly relates to an apparatus for providing control of the range of motion of a human shoulder.

22 Claims, 28 Drawing Sheets

U.S. PATENT DOCUMENTS

| | | | | |
|---|---|---|---|---|
| 6,676,612 | B1 * | 1/2004 | Beny et al. | 601/5 |
| 6,695,795 | B2 * | 2/2004 | Knoll | 601/5 |
| 6,821,288 | B2 * | 11/2004 | Schaeffer | 606/240 |
| 6,824,498 | B2 * | 11/2004 | Hassler | 482/1 |

FOREIGN PATENT DOCUMENTS

| | | |
|---|---|---|
| WO | WO 99/03440 | 1/1999 |

* cited by examiner

Initial Position $\gamma = Fxd$

Extended Position

SHOULDER EXTENSION CONTROL DEVICE

CROSS REFERENCE TO RELATED APPLICATION

This application claims the benefit of provisional patent application Ser. No. 60/341,371 filed Dec. 13, 2001. The present application claims the full benefit and priority of said application, and incorporates the entire contents of same by reference.

FIELD OF THE INVENTION

The present invention relates generally to methods and apparatus for providing range of motion to a joint, and particularly relates to a apparatus for providing substantially complete control over the range of motion of the human shoulder.

BACKGROUND OF THE INVENTION

The shoulder remains one of the most complex joints in the human body. It is composed of the clavicle or collar bone, the scapula or shoulder blade and the humerus or arm bone. There are two important joints in the shoulder: the glenohumeral joint or the joint between the arm bone and the shoulder blade, and the acromioclavicular joint or the joint between the collar bone and the shoulder blade.

There are three layers in the glenohumeral joint of the shoulder. Each layer provides a specific function to the joint. The most superficial layer is the deltoid muscle. It is one of the main motors of glenohumeral motion. The next layer is the rotator cuff musculature. It is a series of four muscles which connect the humerus to the shoulder blade and contributes to the fine motions of the glenohumeral joint. Finally there is the glenohumeral capsular ligaments which are fibrous connections between the humerus and the scapula. They control the extent of motion between the humerus and the scapula.

When the shoulder is injured or the shoulder has surgery, there is a loss of separation between the three layers of the glenohumeral joint. This is caused by excessive scar formation between the layers. Furthermore, there can be shortening or contracture of each individual layer during the injury or surgery process. Both the contracture of each layer and the scar formation between the layers causes a loss of motion between the humerus and scapula. The same process can occur between the scapula and the clavicle as well as the scapula and the thorax or chest of the patient.

The glenohumeral joint is capable of three specific motions: 1. abduction and adduction; 2. internal and external rotation; and 3. flexion and extension. Every position of the glenohumeral joint is a combination of these motions. Abduction of the humerus causes it to move away from the midline whereas adduction moves it towards the midline. Internal rotation of the humerus causes the forearm to rotate towards the body when the humerus is held at the patient's side whereas external rotation causes the forearm to rotate away from the body when the humerus is held at the patient's side. Finally, flexion of the humerus causes it to move forward away from the body whereas extension causes the humerus to backward away from the body.

There are two forms of therapy to help patients gain range of motion in injured or surgically impaired joints with motion loss. The first is manual therapy, which is a stretching program requiring direct hands-on manipulation by a therapist with the express intent of increasing motion in the affected joint. The second is mechanical therapy, which is a specific medical device designed to allow the patient to stretch the joint without the help of a therapist. It has been shown that the use of mechanical devices to assist the patient in gaining range of motion are both helpful and highly desired as a technique to help avoid surgical treatment of joint motion loss.

Therefore it is known to provide apparatuses which increase the range of motion for a shoulder. However, improvements are always welcomed.

SUMMARY OF THE INVENTION

Generally described, the present invention relates to methods and apparatus for providing complete patient control of joint range of motion and particularly relates to a apparatus for providing control of the range of motion of a human shoulder.

More particularly described, one aspect of the present invention relates to an apparatus for manipulating the shoulder joint of a human user, the apparatus comprising a frame including spaced apart first and second mounting locations, an arm carriage configured to manipulate the shoulder joint of the user, the arm carriage configured to be mounted to either the first or second mounting location of the frame, a power unit configured to provide power upon control by the user, the power unit configured to be mounted to the other of the first or second mounting location of the frame, a linkage intermediate the arm carriage and the power unit, the linkage configured to transfer power from the power unit to the arm carriage, the arm carriage, the power unit, and the linkage configured to allow the arm carriage and the power unit to be switched between the first and second mounting locations and operated in alternating modes, such that in a first operating mode the arm carriage can manipulate the right arm of the user, and such that in a second operating mode the arm carriage can manipulate the left arm of the user.

Therefore it is an object of the present invention to provide an improved methods and apparatus for providing complete patient control of joint range of motion.

Other objects, features, and advantages of the present invention will become apparent upon reading the following detailed description of the preferred embodiment of the invention when taken in conjunction with the drawing and the appended claims.

BRIEF DESCRIPTION OF THE DRAWINGS

Having thus described the invention in general terms, reference will now be made to the accompanying drawings, in which like numerals indicate like elements throughout the several views.

FIGS. 1-16 are directed towards a first embodiment of the invention.

FIGS. 17-29 are directed towards a second embodiment of the invention.

Figure 1:
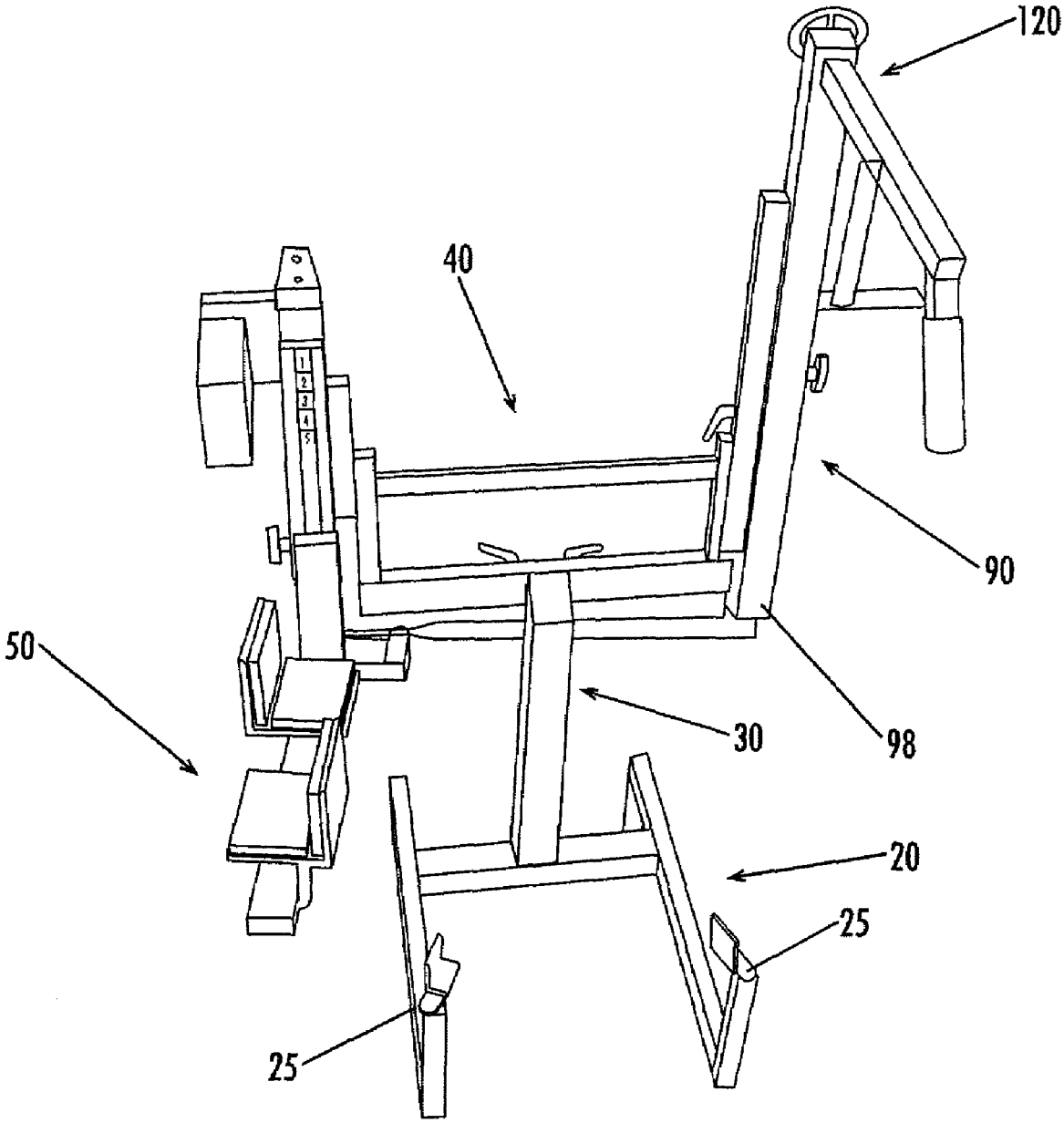
Figure 2:
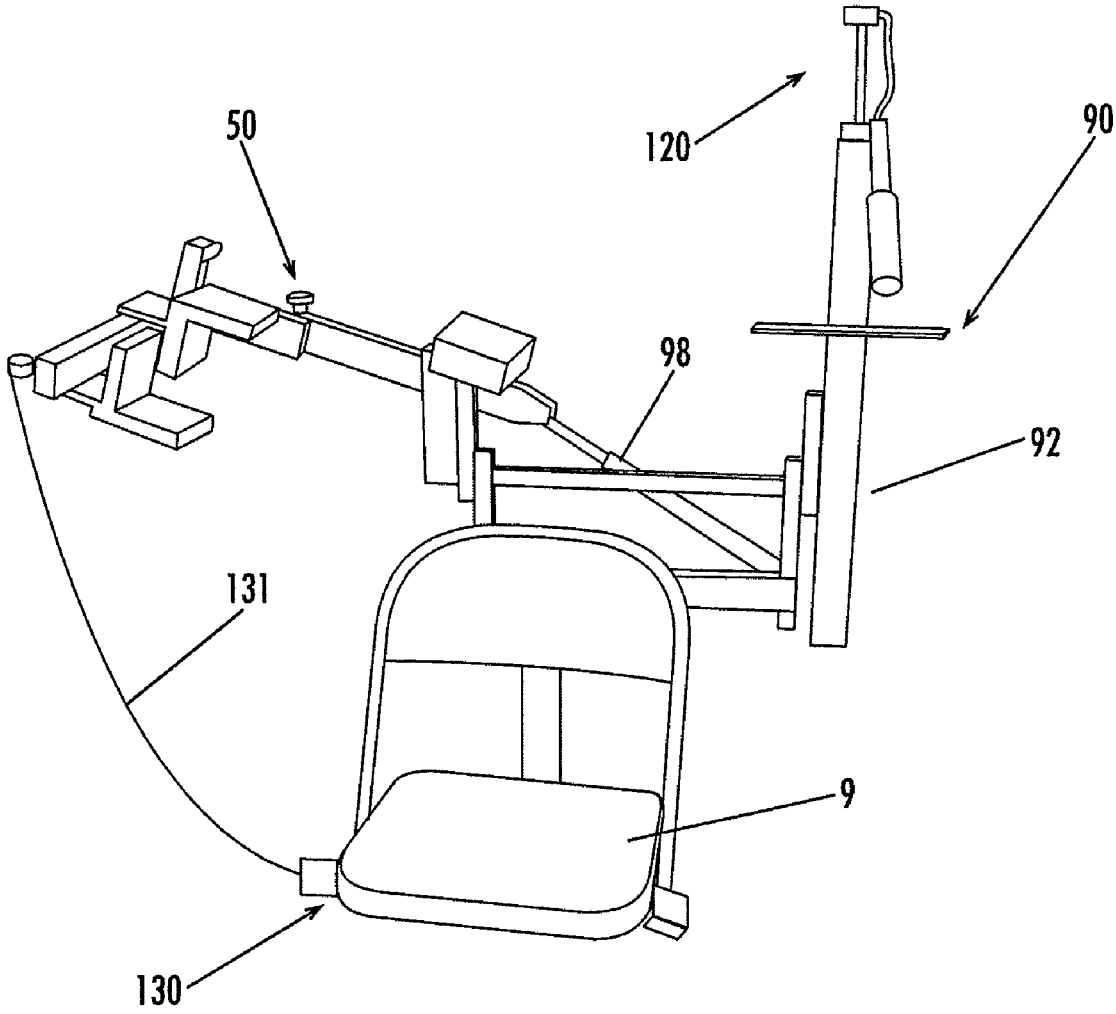

FIGS. 1 and 2 show a first embodiment of the apparatus 10, with FIG. 1 showing the apparatus 10 without an associated folding chair and FIG. 2 showing the apparatus 10 with an associated chair 9.

Figure 3:
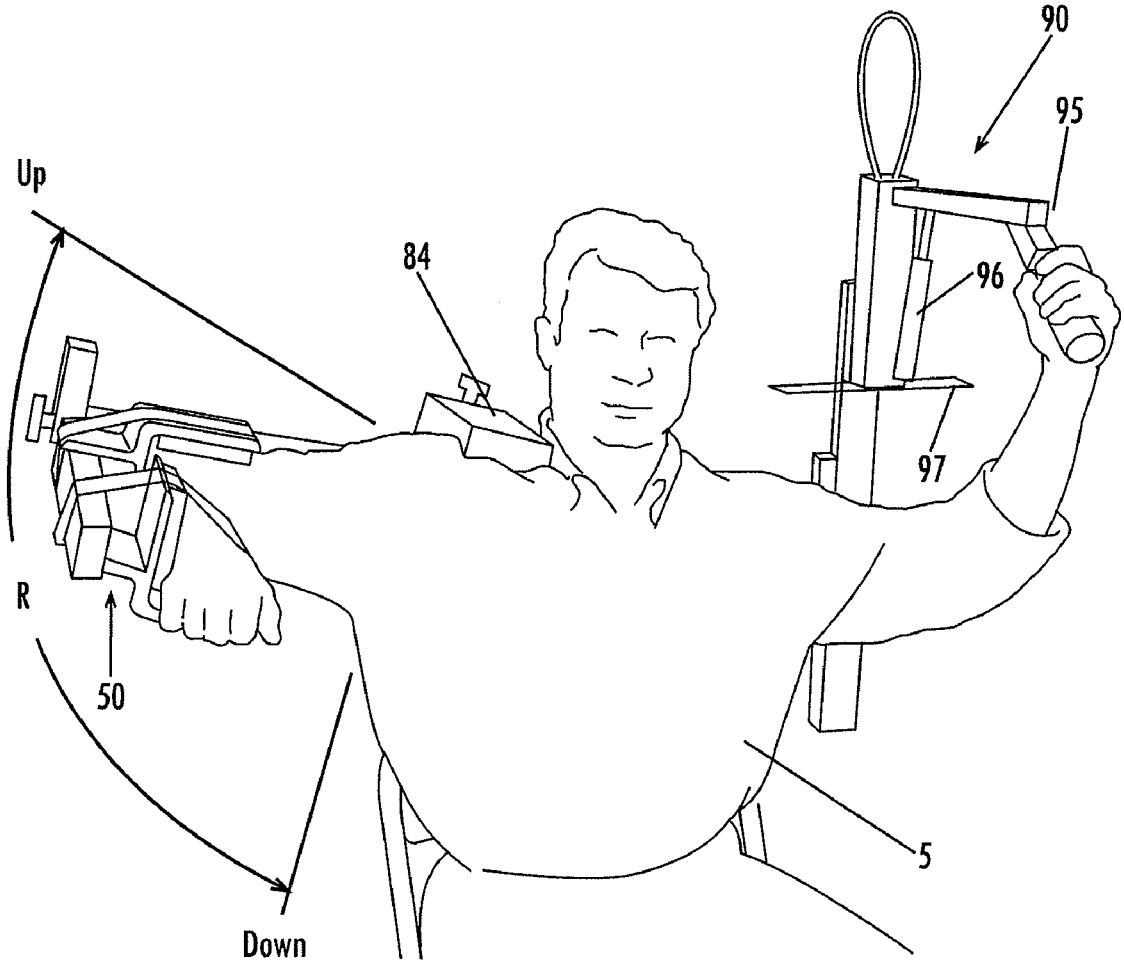

FIG. 3 shows a user 5 demonstrating the apparatus 10 as it provides abduction to, in this instance, the right shoulder of the user 5.

Figure 4:
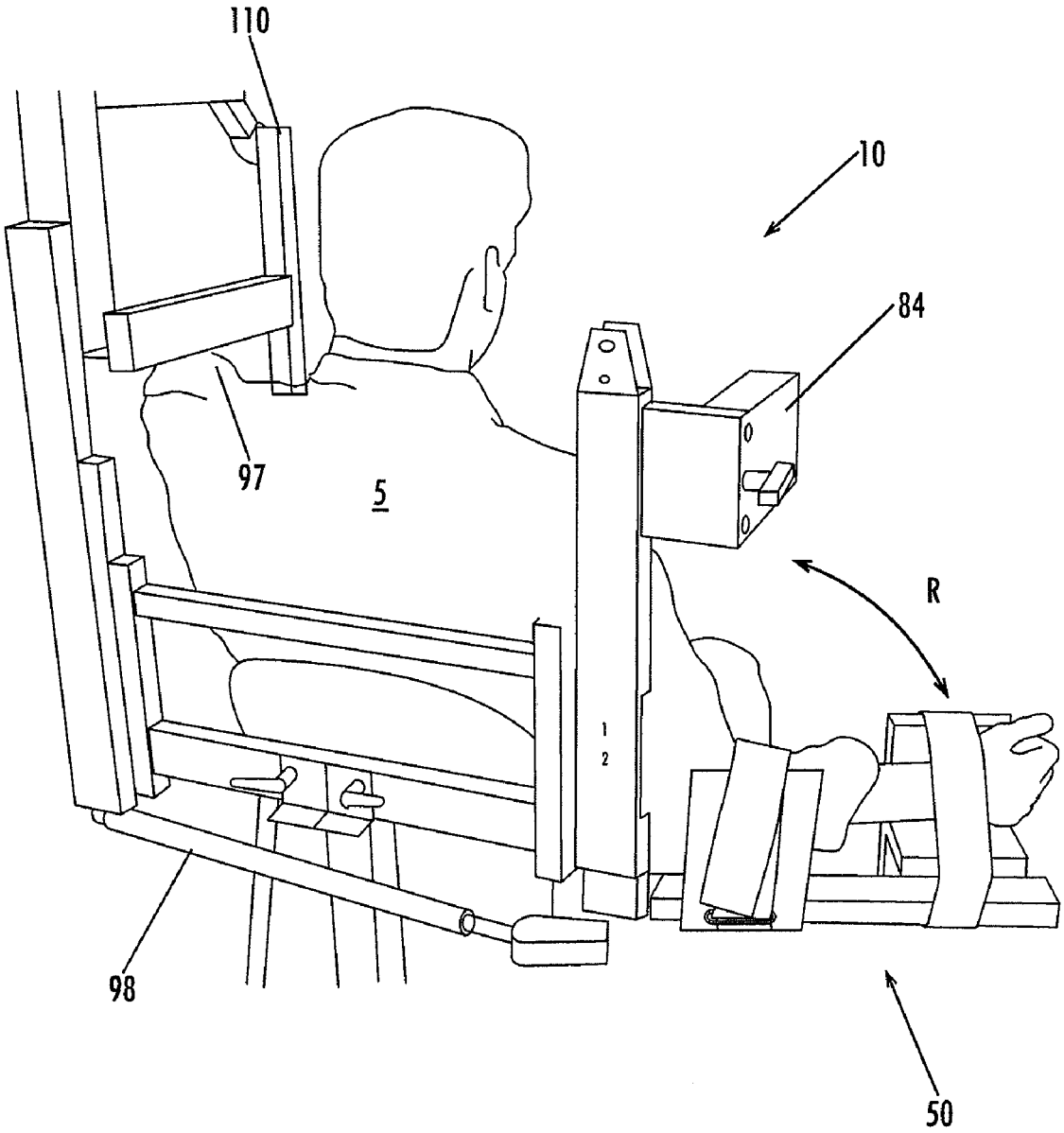

FIG. 4 shows a user 5 (viewed from the rear of the apparatus), situated within the apparatus 10, with the user's right arm in the arm carriage 50, and the apparatus 10 providing external rotation to the user's right shoulder within a range "R".

Figure 5:
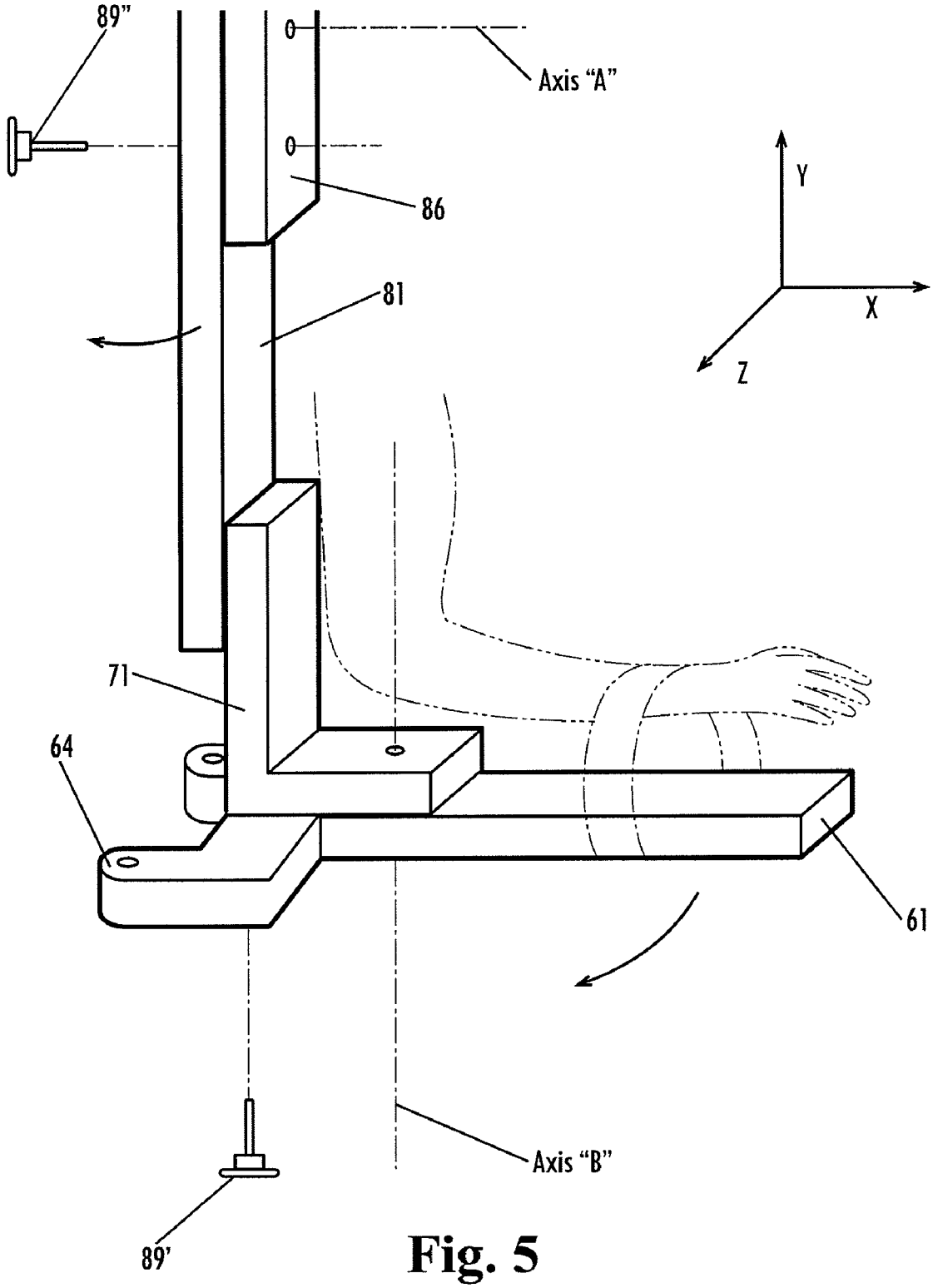

FIG. 5 can be used to show the use of a single pivot-fixing pin 89, alternately positionable at two separate locations, in order to provide two differing pivoting configurations.

Figure 6:
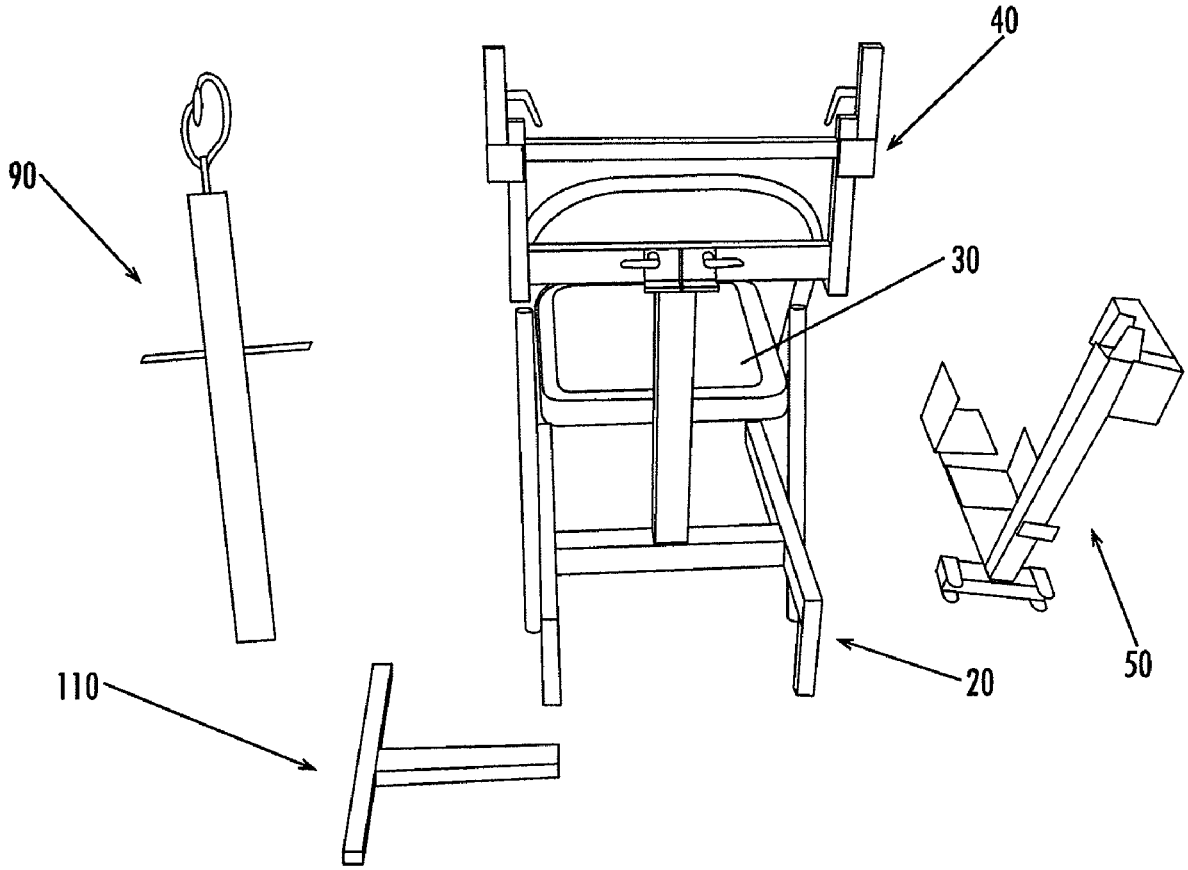

FIG. 6 is a disassembled view of the apparatus 10, with the various subapparatuses shown spaced apart. Specifically, subapparatuses 50 and 90 and 110 are shown spaced apart from the main portion of the apparatus. Subapparatus 50 is the arm carriage subapparatus, and is configured to accept the arm of a user. Subapparatus 90 is the power unit subapparatus 90, and is configured to convert mechanical energy from the user to hydraulic energy. Subapparatus 110 is a torso retaining assembly.

Figure 7:
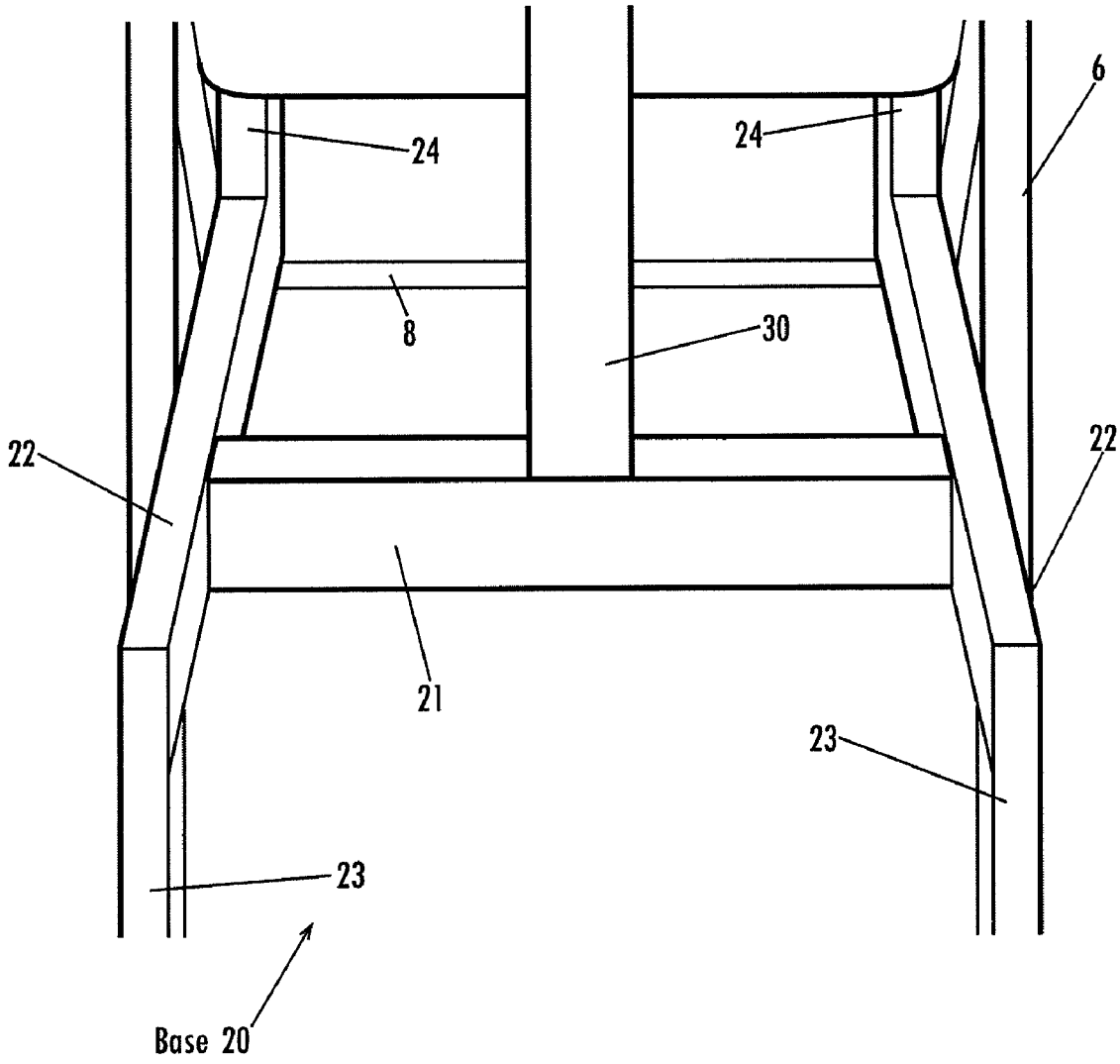

FIG. 7 is a more detailed front view of the base 20 of the apparatus. The base 20 includes a horizontal transverse member 21, a pair of horizontal side members 22, rear feet 23, front posts 24, and front post flanges 25 (not shown in FIG. 7 but shown in FIG. 1).

Figure 8:
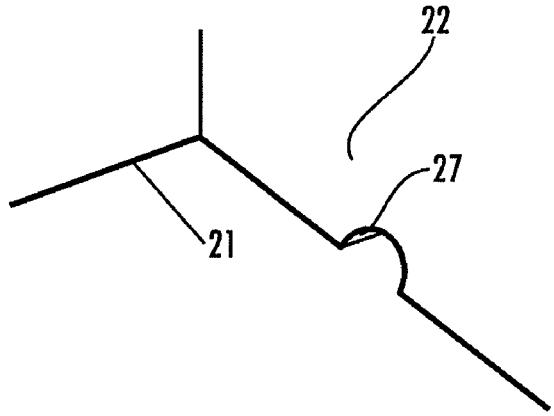

FIG. 8 is a detailed view showing one of two downwardly facing slots 27.

Figure 9:
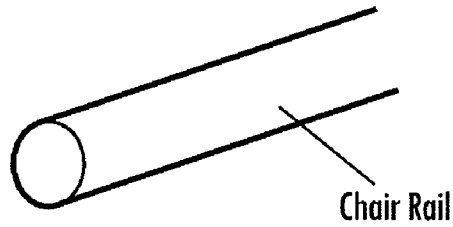
Figure 9:
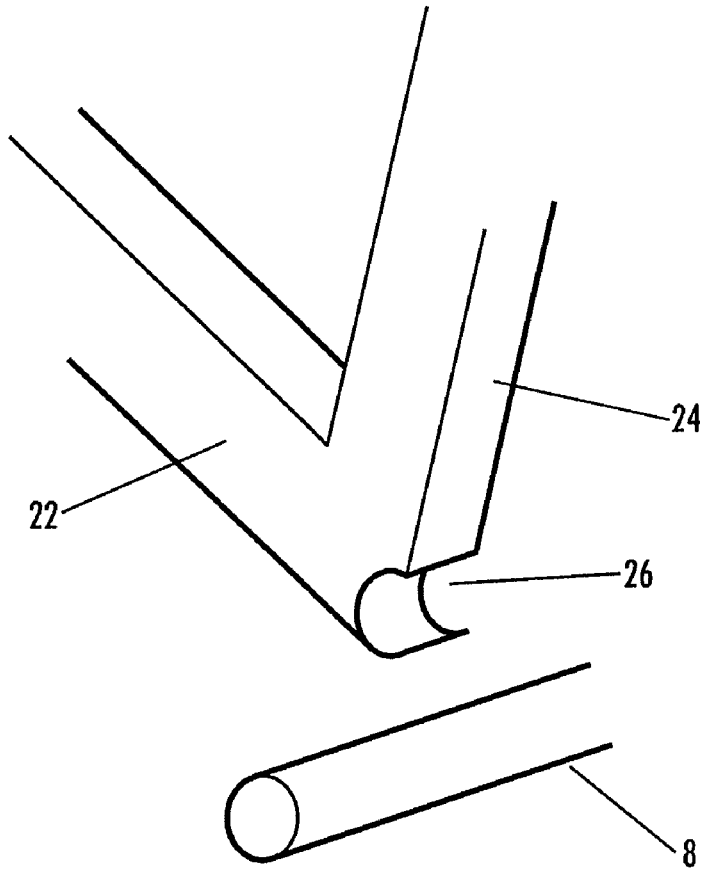

FIG. 9 is a detailed view showing one of two forwardly facing slots 26, which is located in a corresponding one of the horizontal side members 22.

Figure 10:
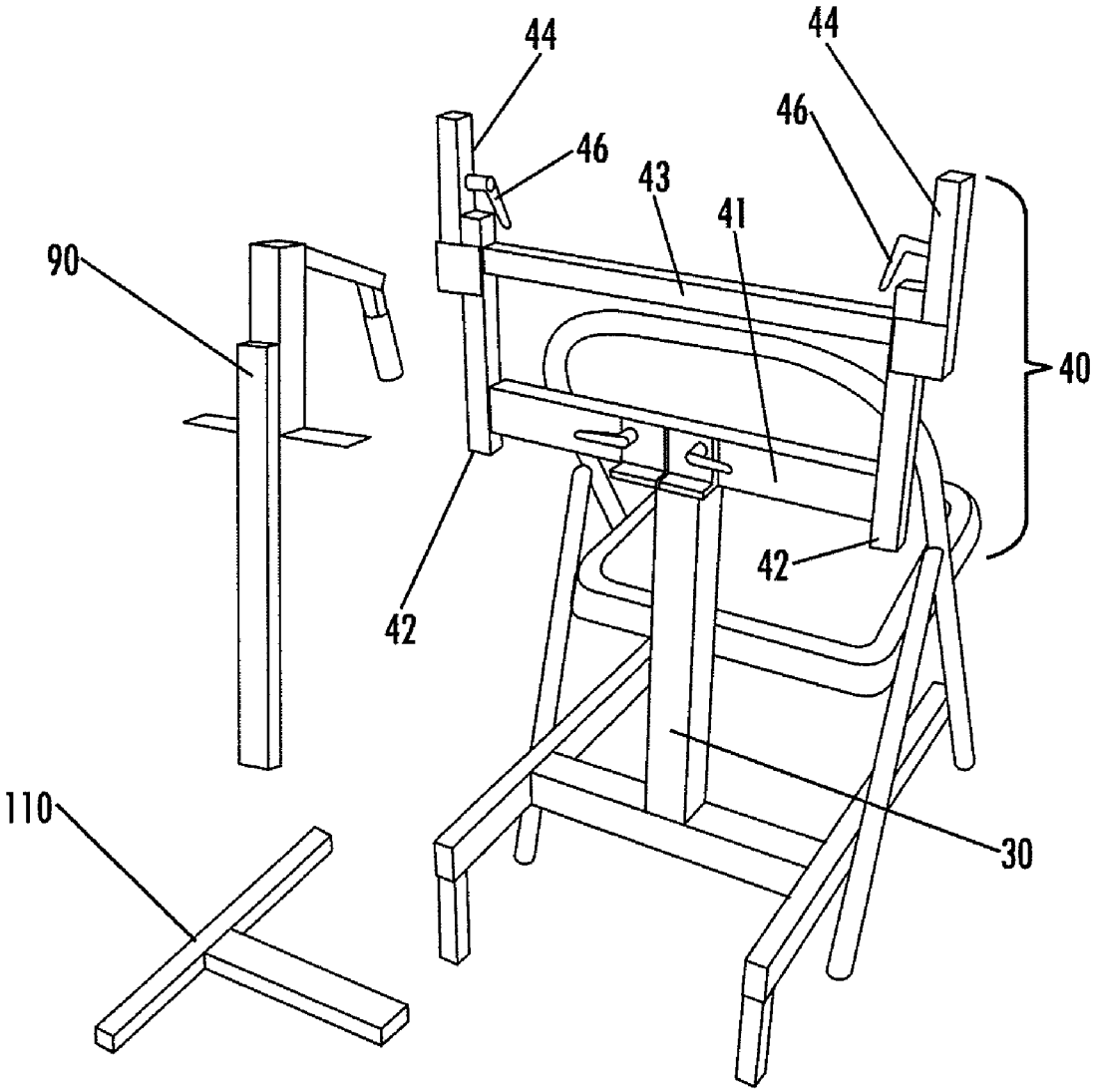

FIG. 10 is a view of a portion of the apparatus 10, shown in partially disassembled view, showing particulars of the main frame 40. The main frame 40 includes a main horizontal member 41, a secondary horizontal member 43, side-mounting members 44, and carriage gripping members 46.

Figure 11:
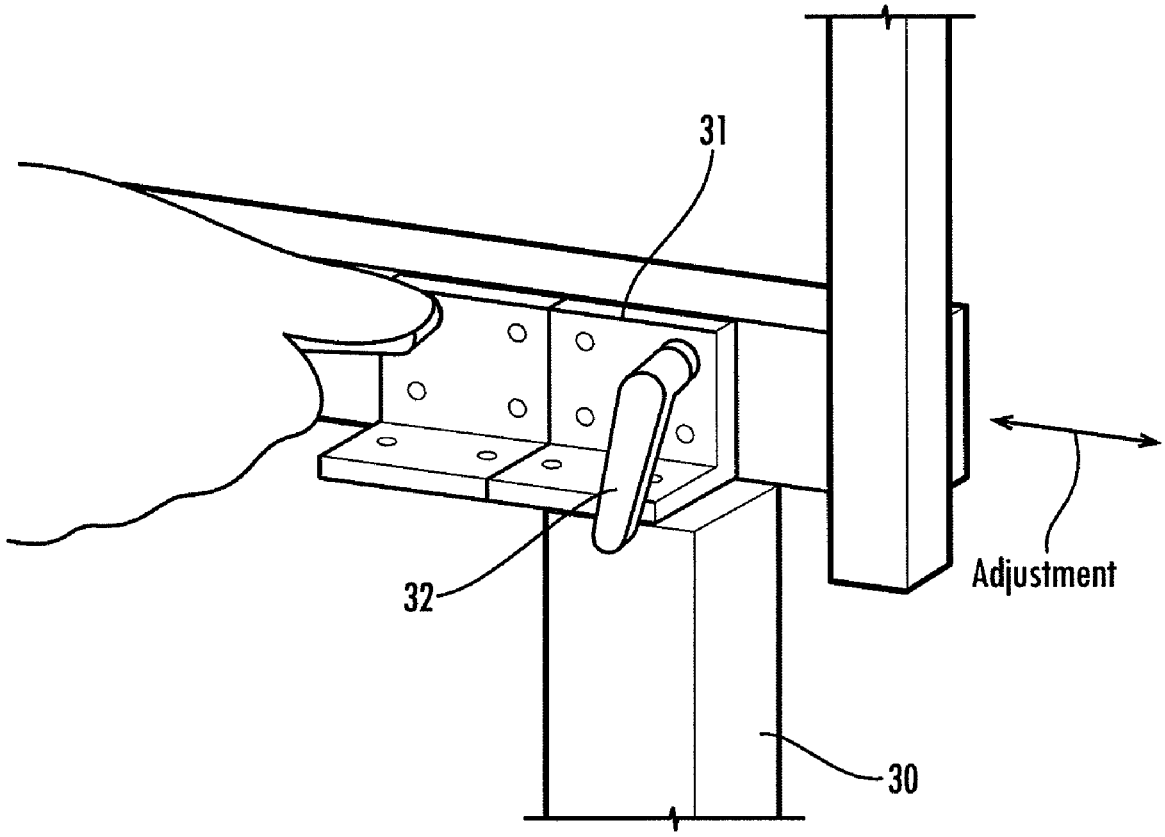

FIG. 11 is a detailed view of the adjustable mounting grip 31 which is located at the top of the spine 30. It should be understood that each adjustable mounting grip 31 includes a corresponding adjustable mounting grip handle 32.

Figure 12:
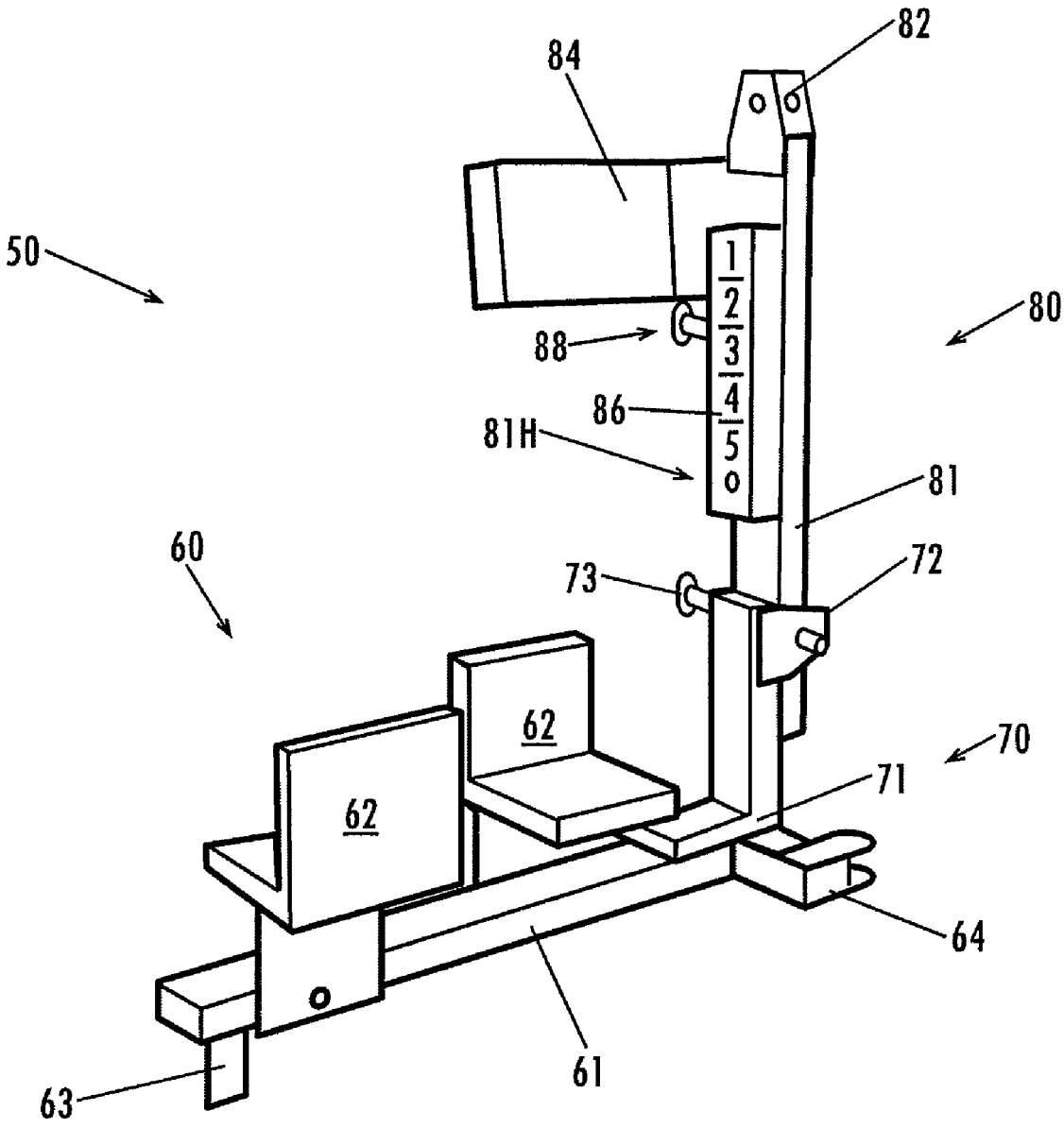

FIG. 12 shows an isolated view of the arm carriage subassembly 50.

Figure 13:
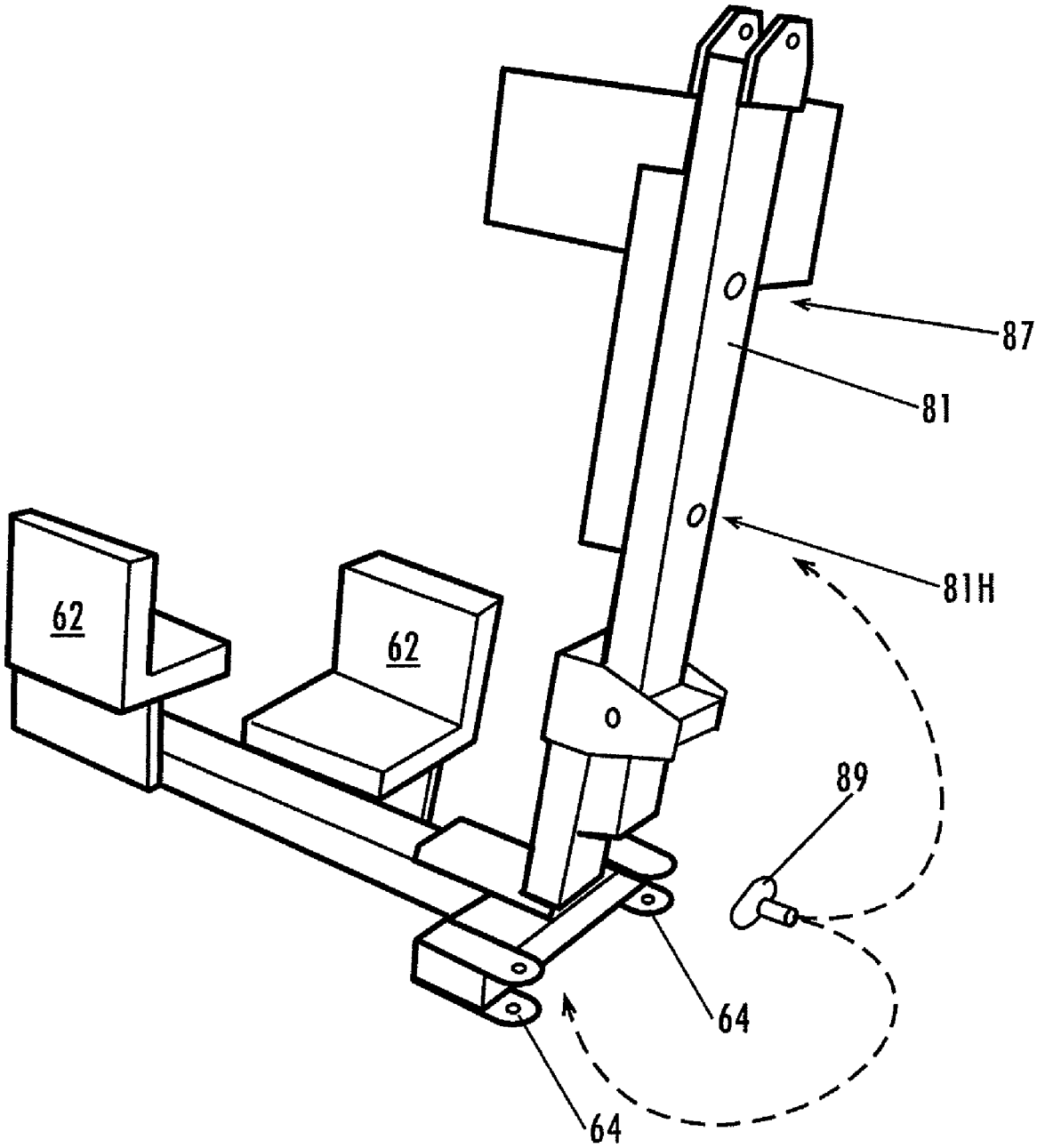

FIG. 13 shows, through the use of dotted lines, the two different holes which this pivot-fixing pin 89 may be used, for differing results. In one type of therapy (abduction), the pivot-fixing pin 89 is used in one hole, whereas in another type of therapy (external rotation), the pivot-fixing pin 89 is used in another hole.

Figure 14:
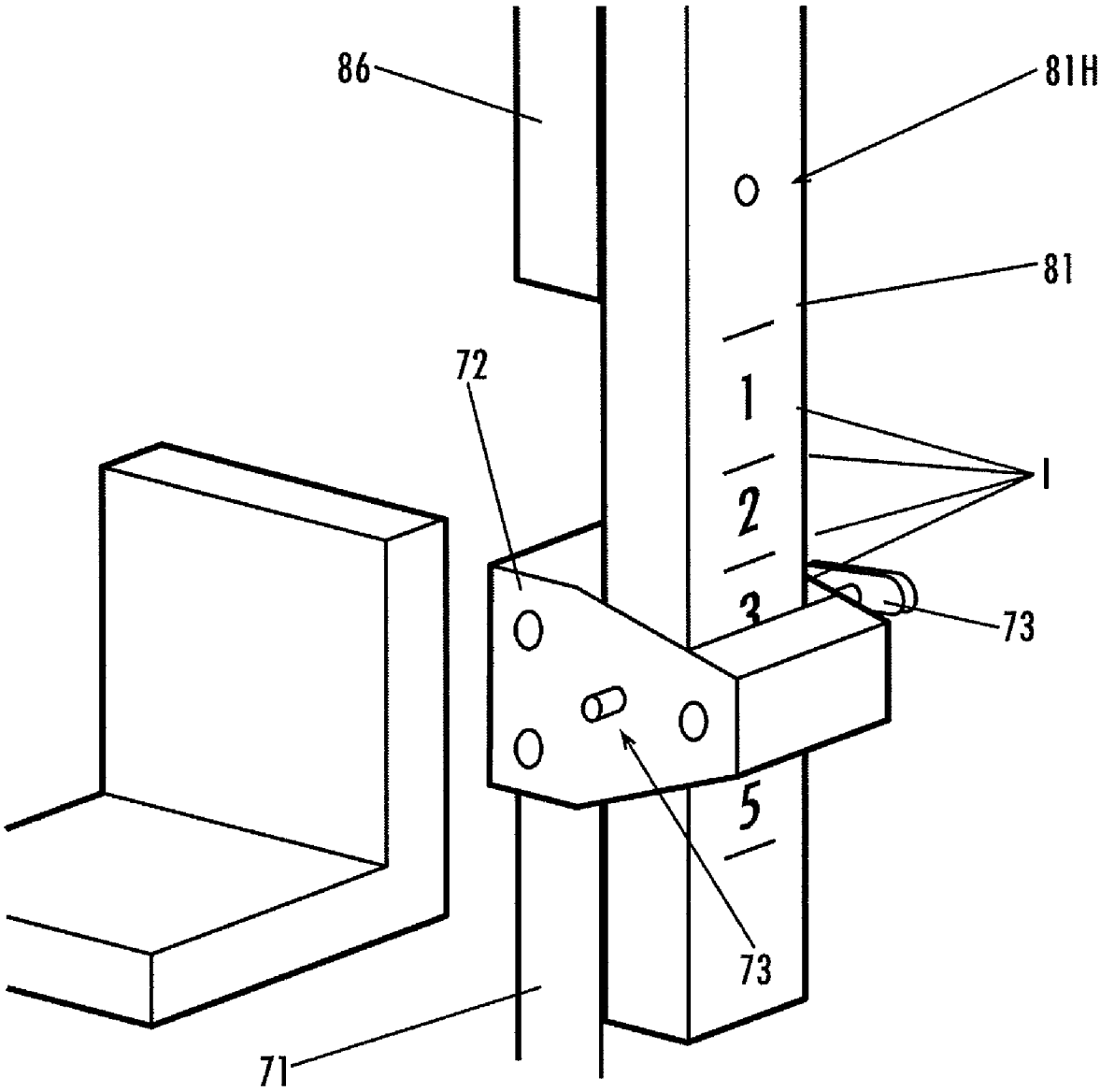

FIG. 14 shows indicia I which is located on the upper arm post 81. This FIG. 14 likewise shows hole 81H, which is defined by the upper arm post 81. It may be understood that this hole 81H is one of the two holes which the pivot fixing pin 89 is configured to be positioned.

Figure 15:
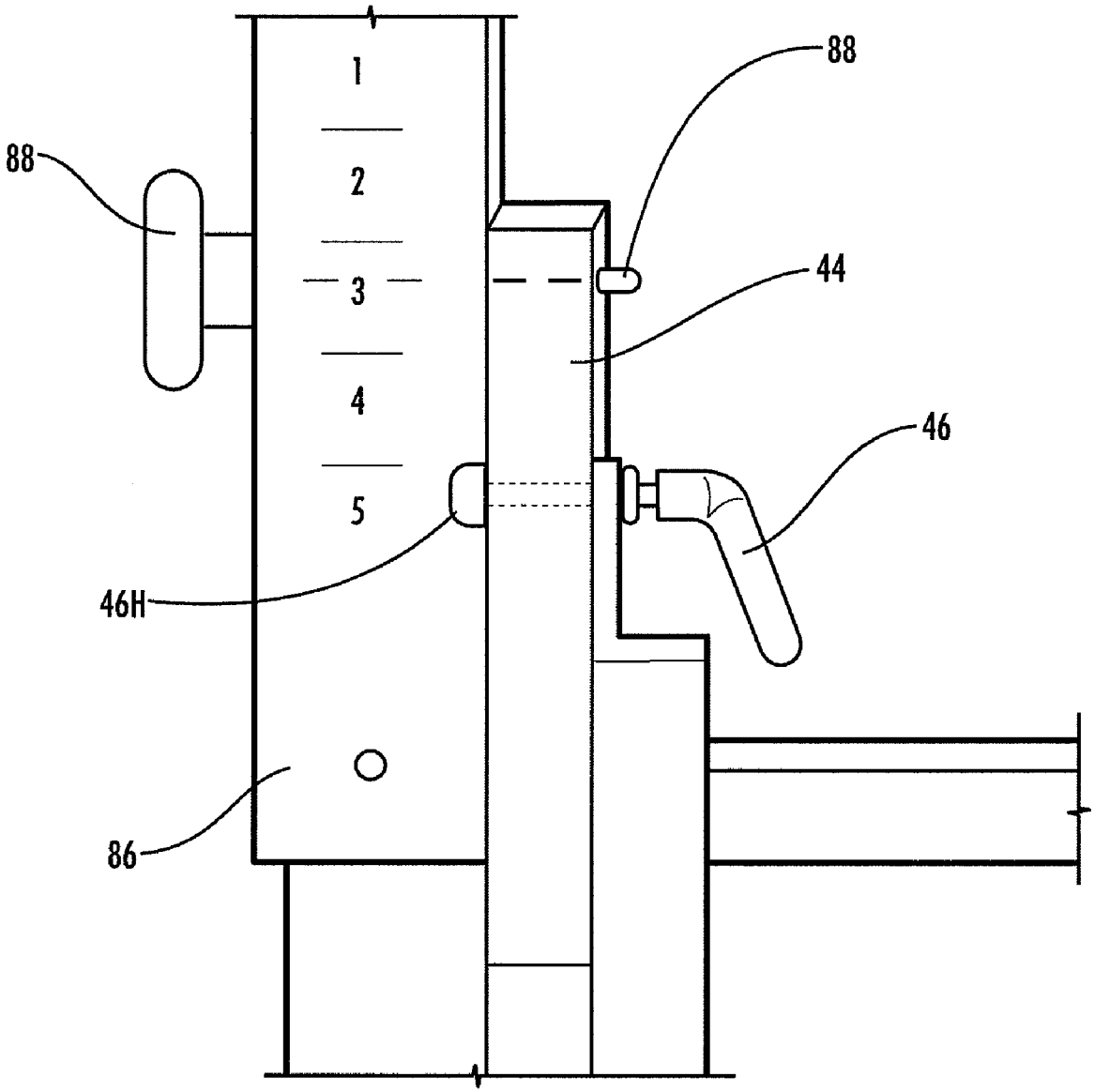

FIG. 15 shows a mounting configuration according to the present invention.

Figure 16:
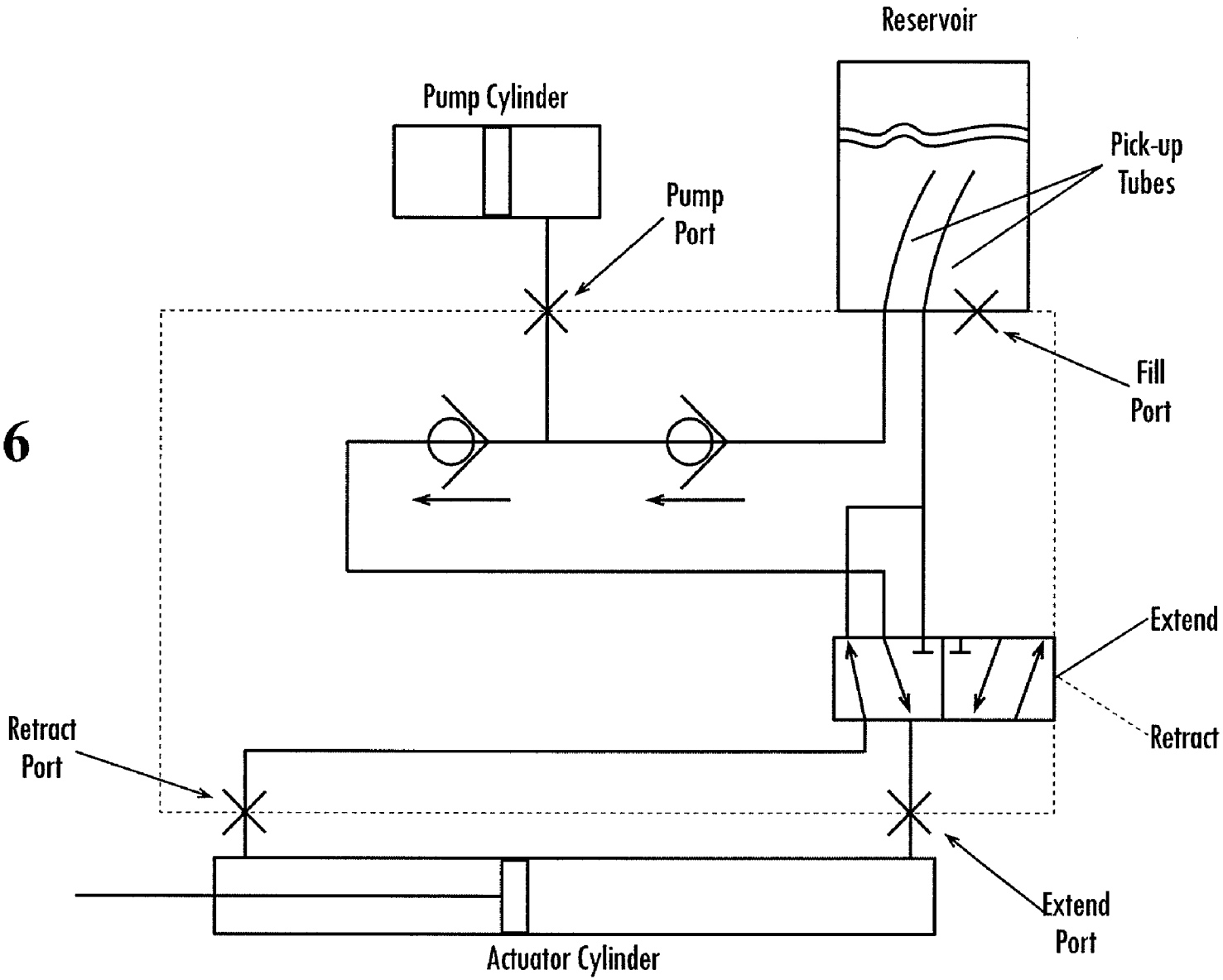

FIG. 16 shows a hydraulic schematic which can be used with both embodiments of the invention.

Figure 17:
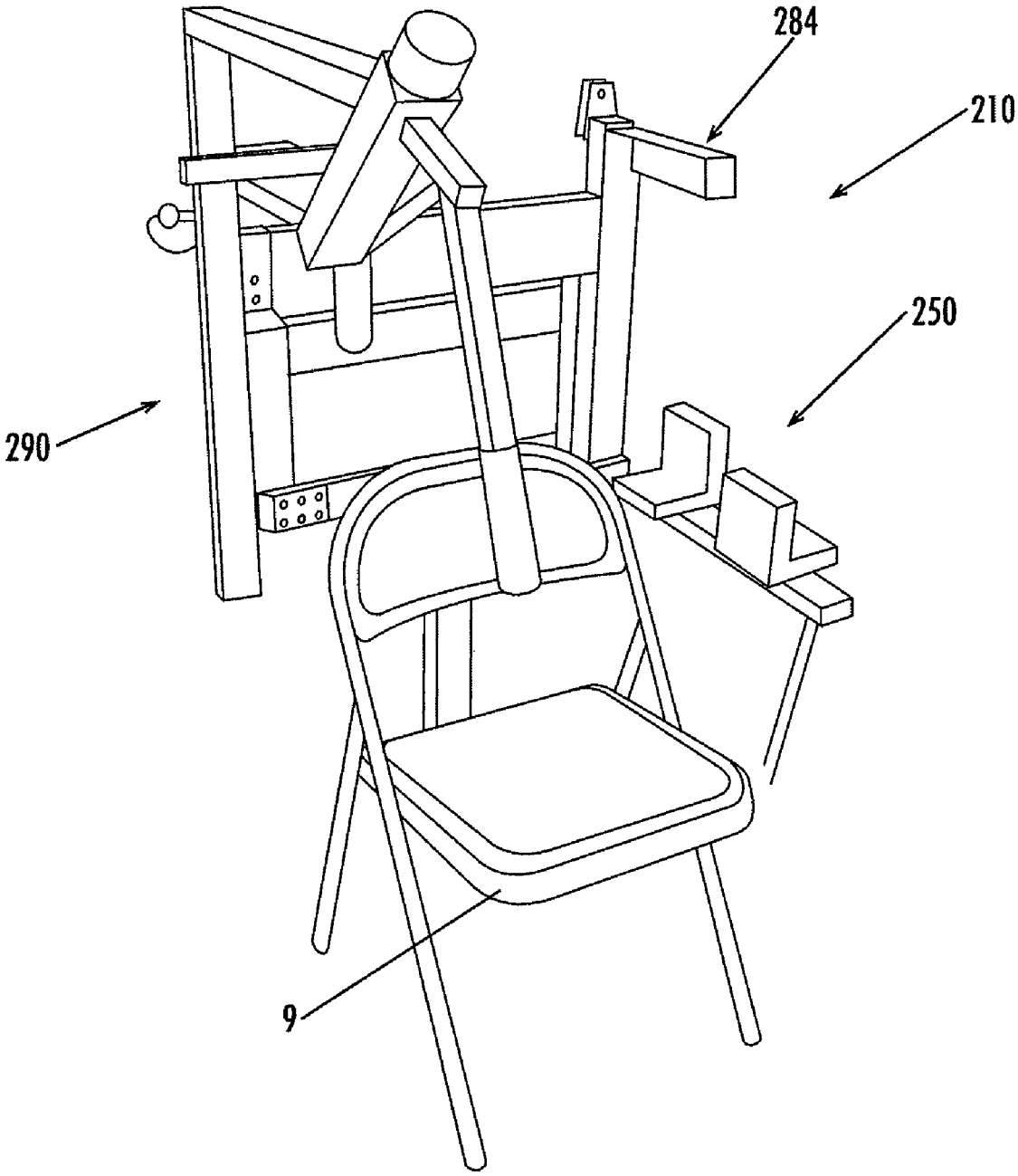

FIG. 17 is a pictorial view of a second embodiment of the invention, as viewed from the front and slightly to the left of the apparatus 210.

Figure 18:
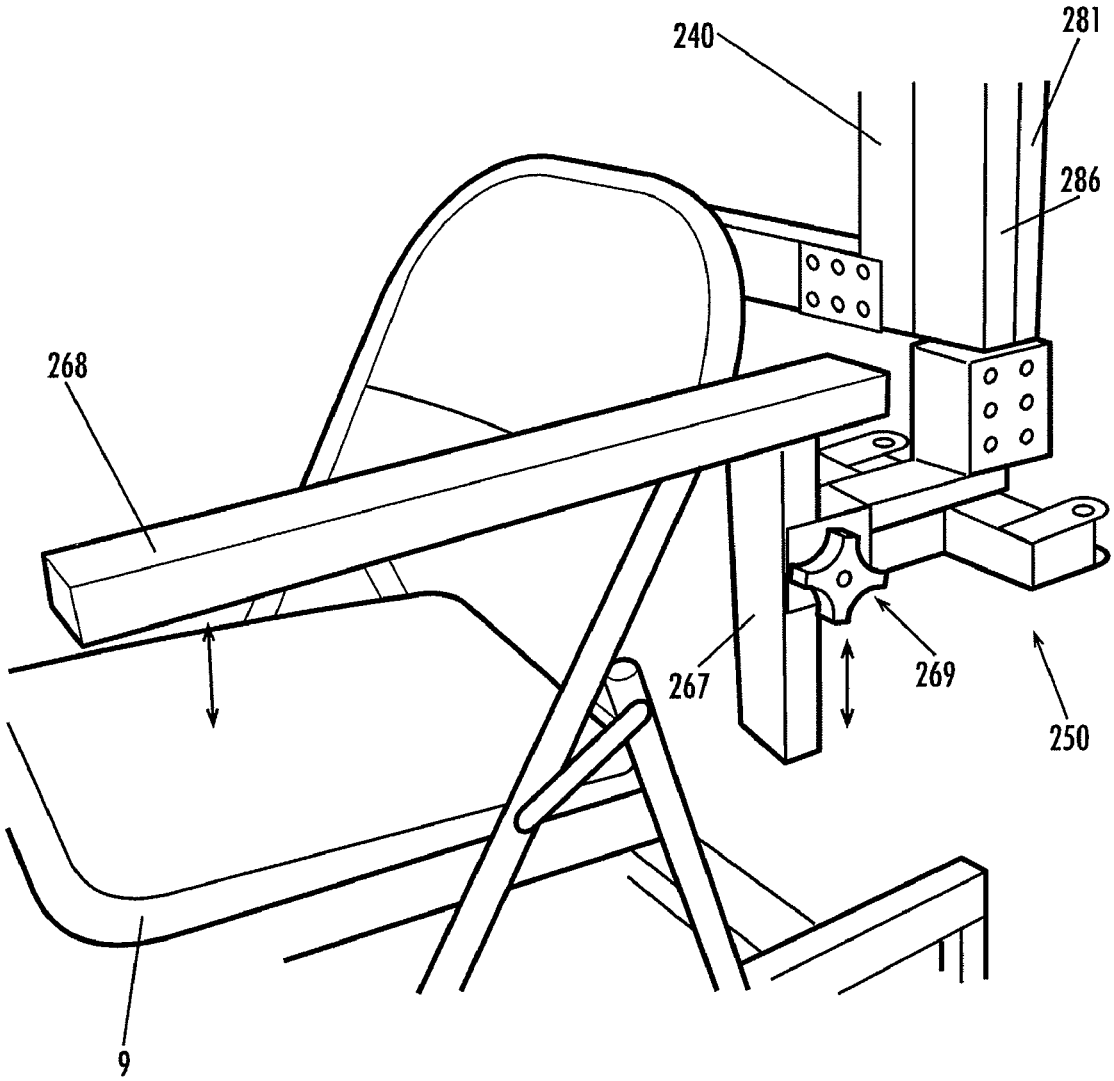

FIG. 18 shows a close-up view of the arm carriage 250, viewed from the left and slightly to the front of the overall apparatus.

Figure 19:
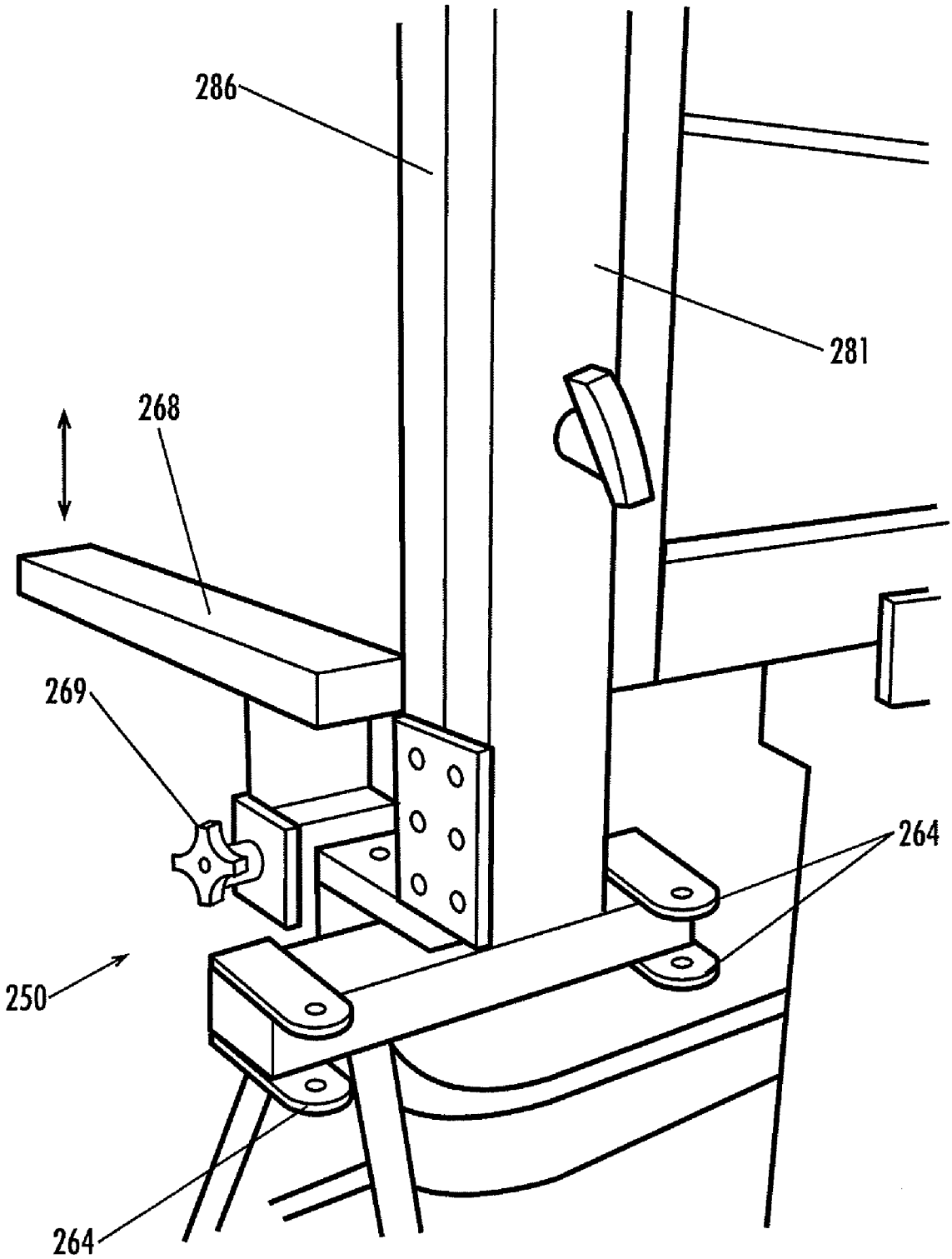

FIG. 19 shows another close-up view of the arm carriage 250, viewed from the left and slightly to the rear of the overall apparatus.

Figure 20:
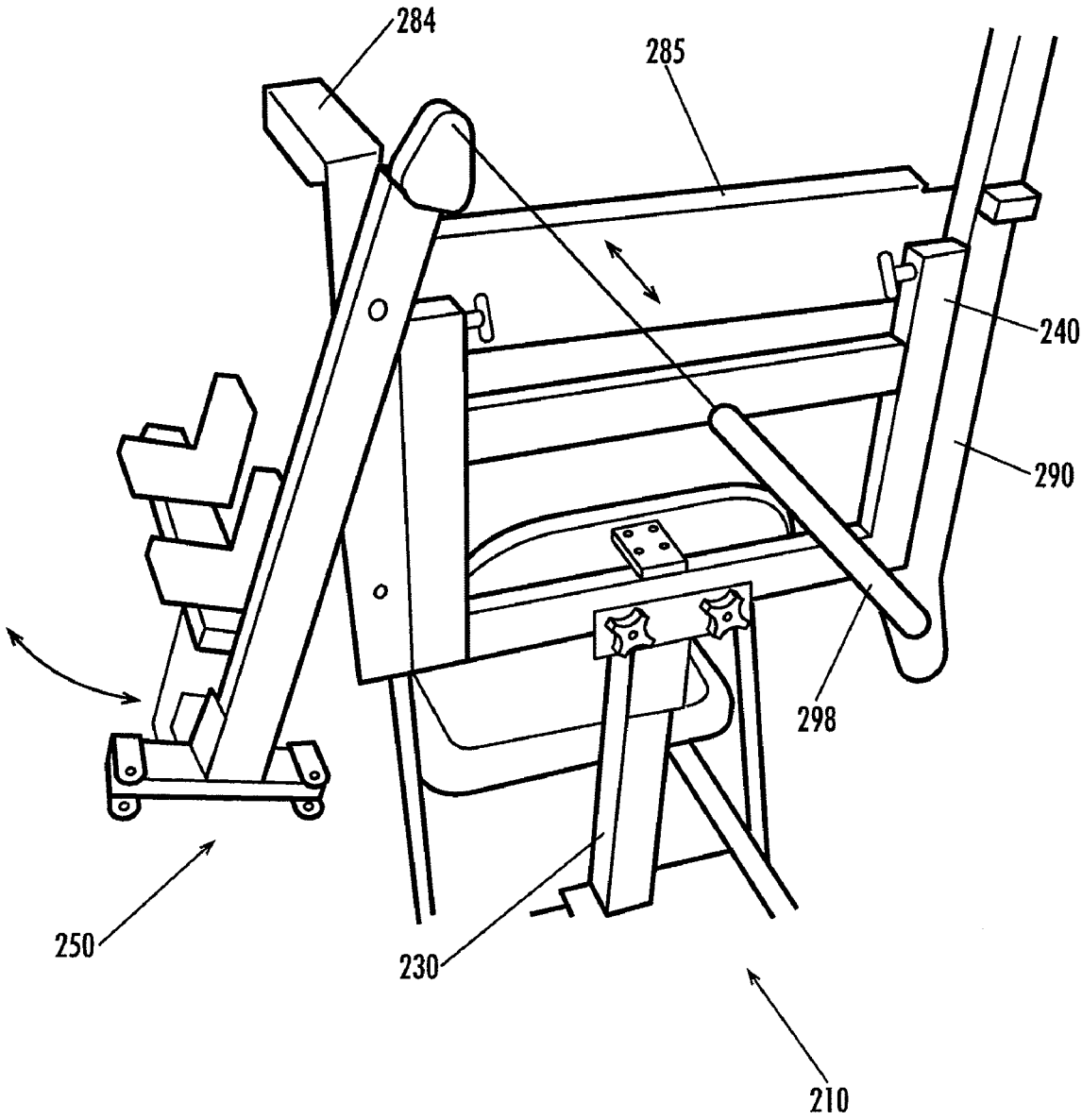

FIG. 20 shows the apparatus 210 in its configuration for working abduction, as viewed from the rear.

Figure 21:
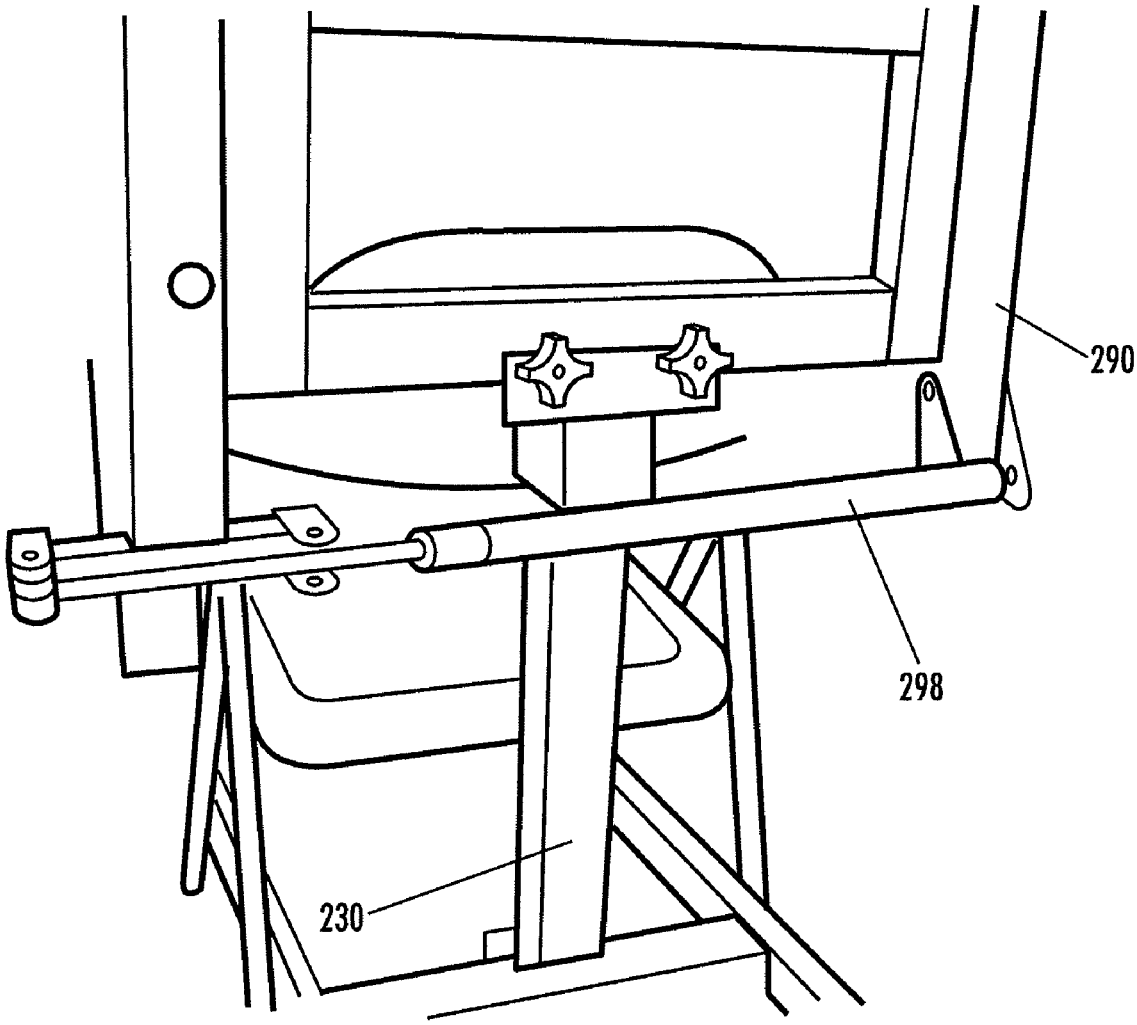

FIG. 21 shows the apparatus 210 in its configuration for external rotation, as viewed from the rear.

Figure 22:
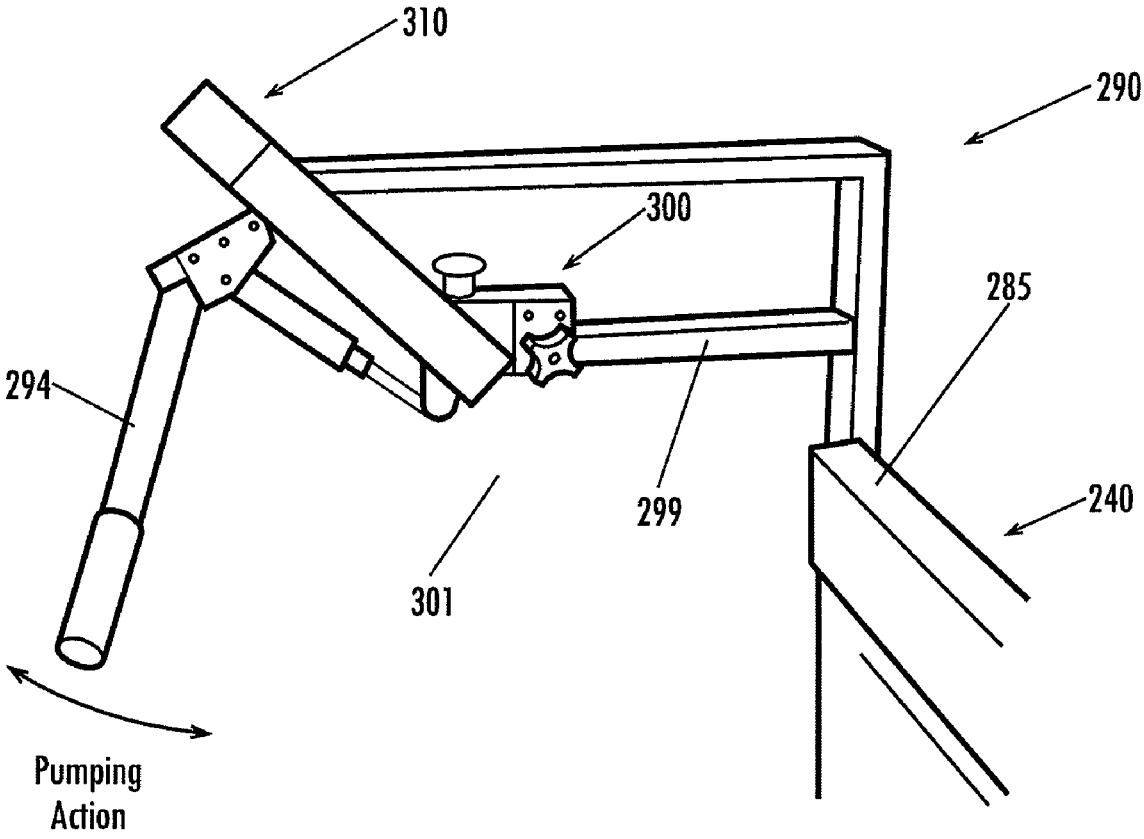

FIG. 22 shows the configuration of the power unit 290 of the second embodiment of the invention. A portion of the frame 240, including an anti-scapular retraction pad 285, is likewise shown in FIG. 22.

Figure 23:
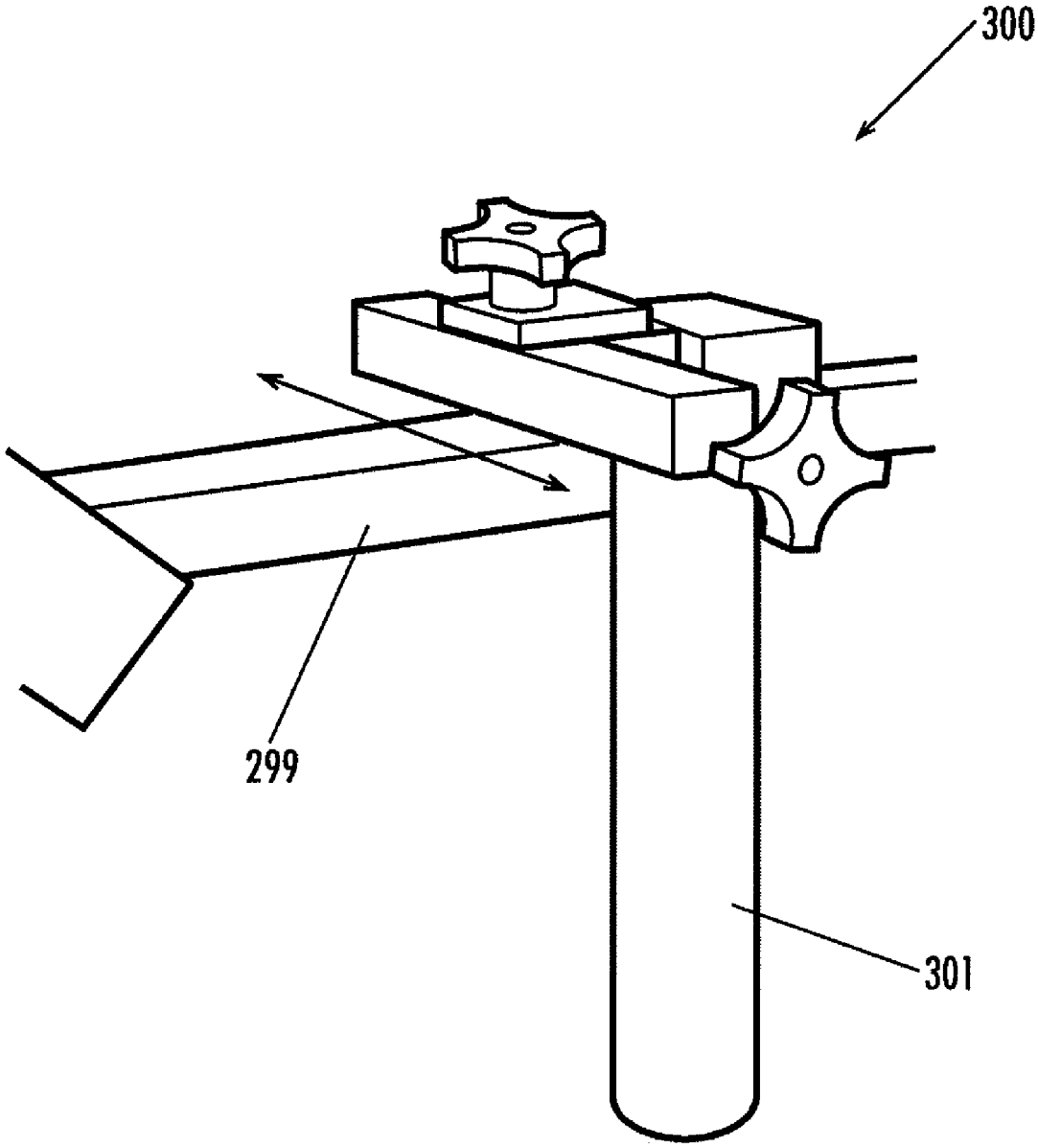

FIG. 23 is a more detailed pictorial view of an anti-opposite shoulder rotation assembly 300

Figure 24:
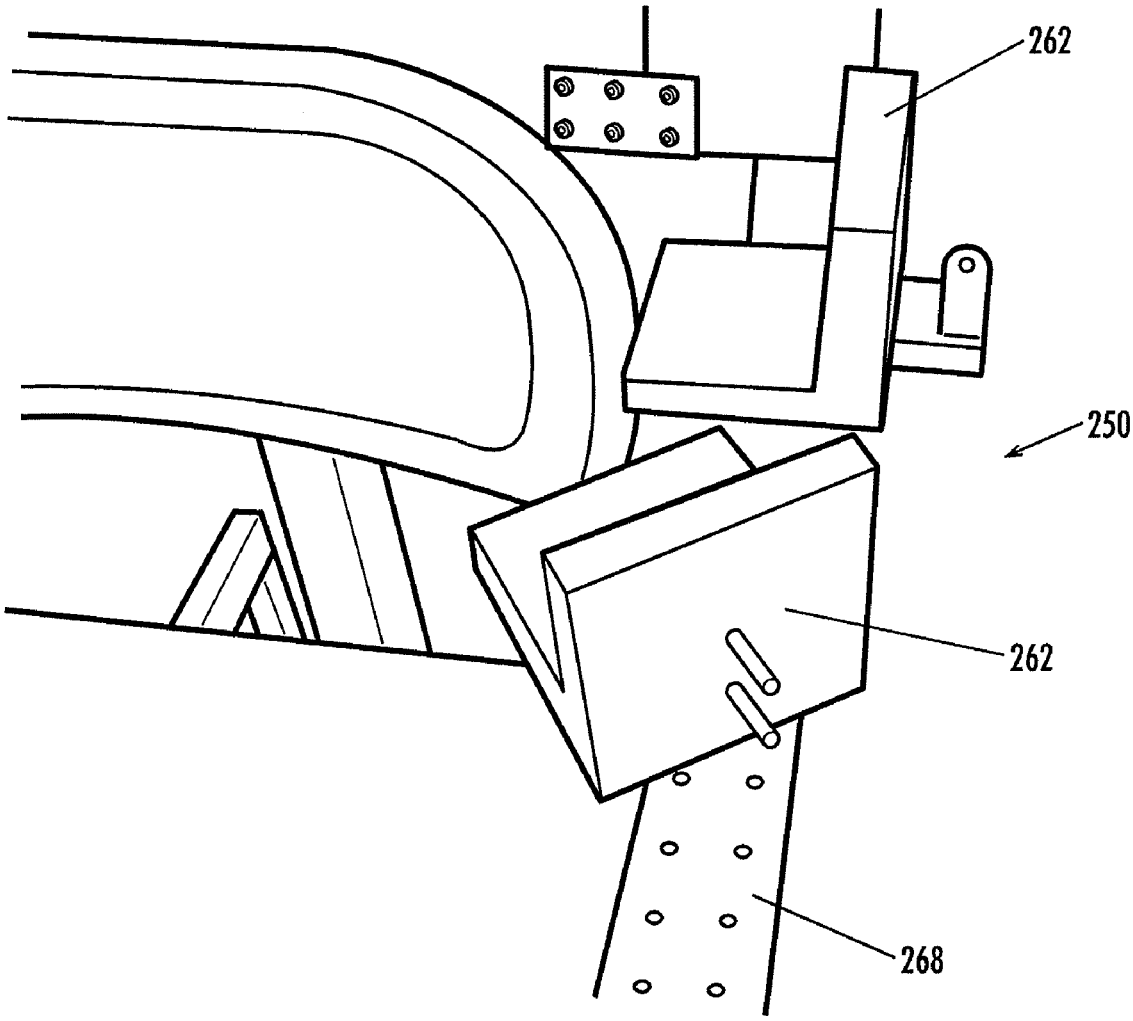

FIG. 24 shows the padded arm cradles 262, which have pins that fit holes in the cradle support bar 268 of the arm carriage 250.

Figure 25:
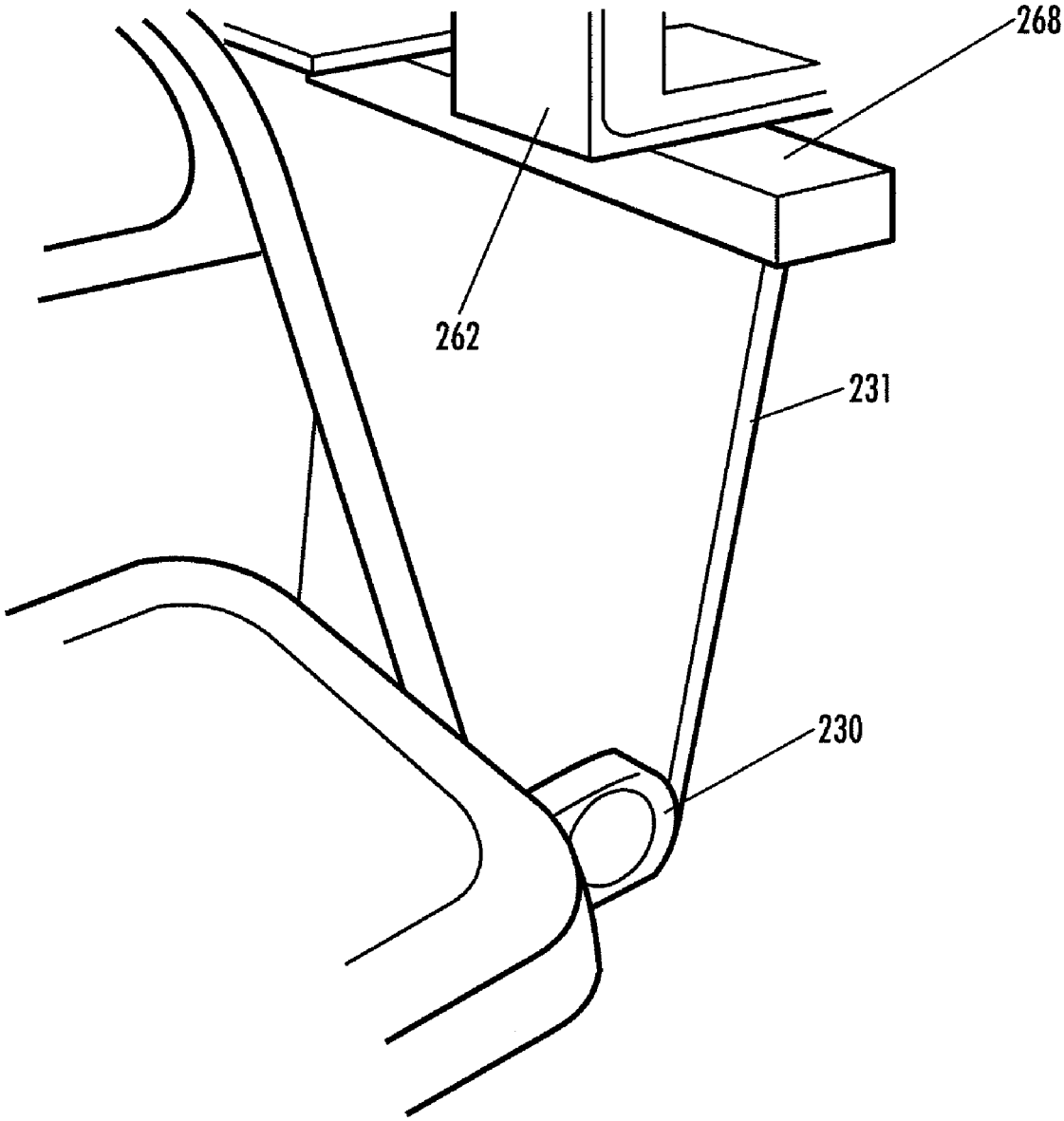

FIG. 25 shows the tape measure 230, which includes tape 231, similar to the configuration of the first embodiment.

Figure 26:
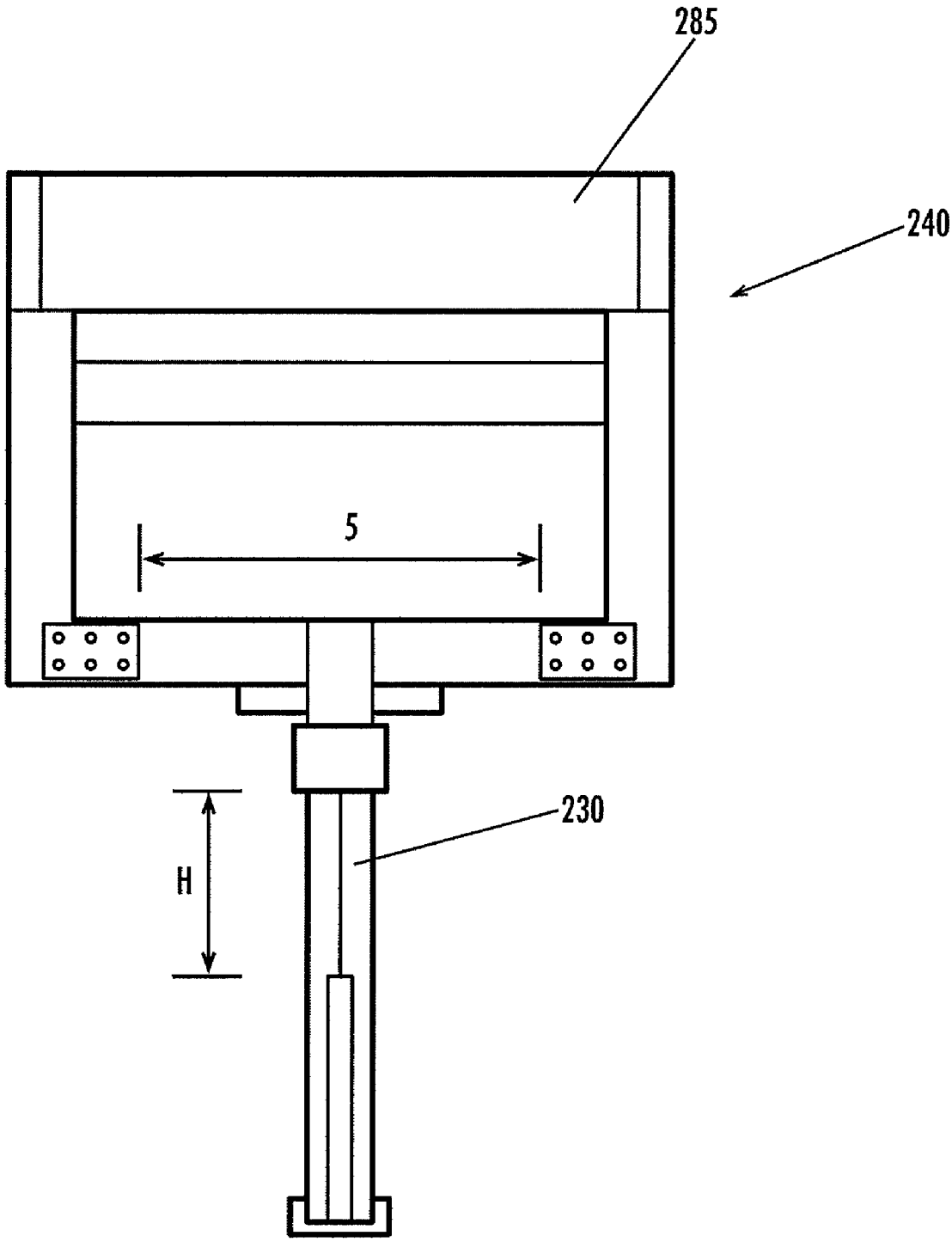

FIG. 26 shows a front elevational view of the spine 230, slidably and adjustably mounted relative to the frame 240. Adjustment arrows are also shown.

Figure 27:
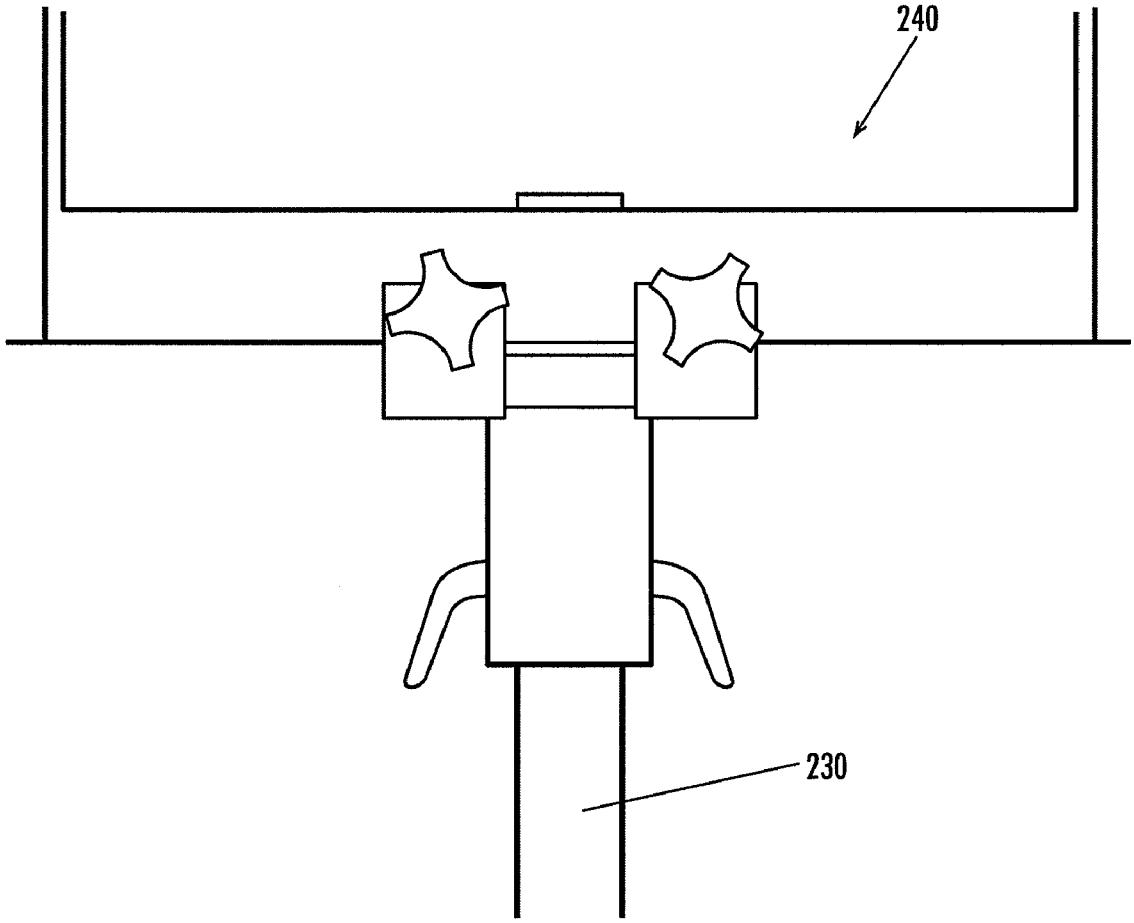

FIG. 27 is a close-up view of both of the locking knobs for horizontal fixation, and the locking keys for vertical fixation. This is a view from the rear of the apparatus.

Figure 28:
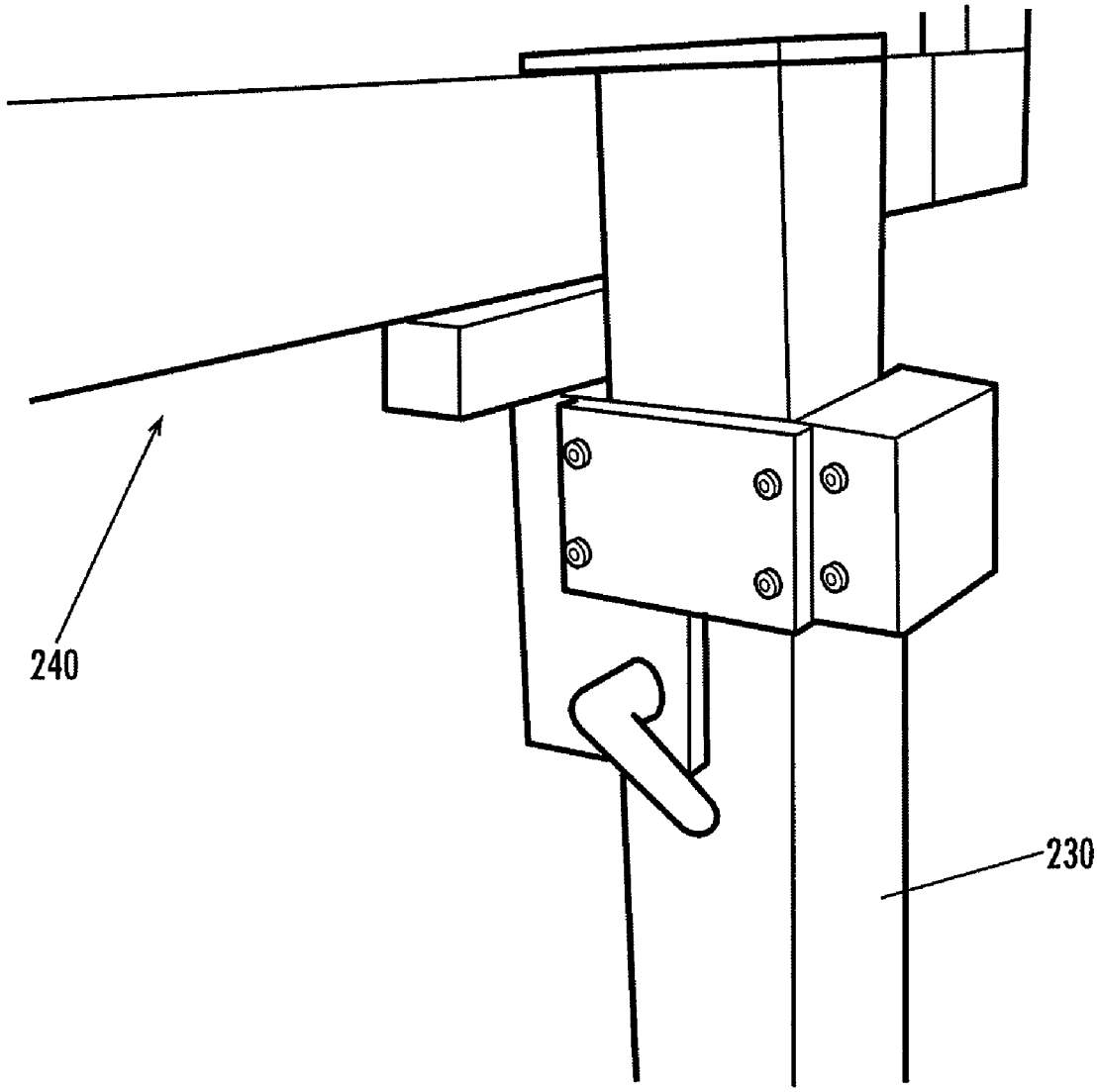

FIG. 28 is a close-up view of one of the locking keys for vertical fixation of the frame 240 relative to the spine 230. This is a view from the right and slightly to the front of the apparatus.

Figure 29A:
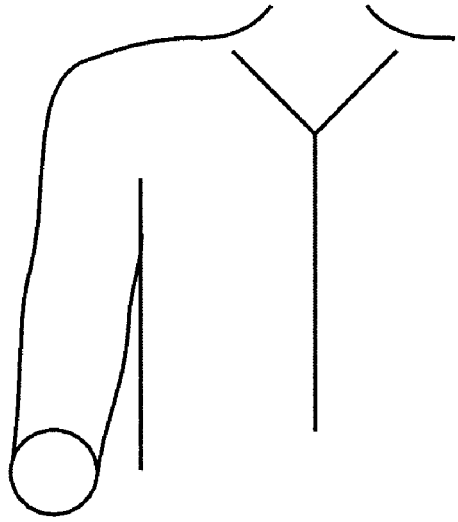
Figure 29B:
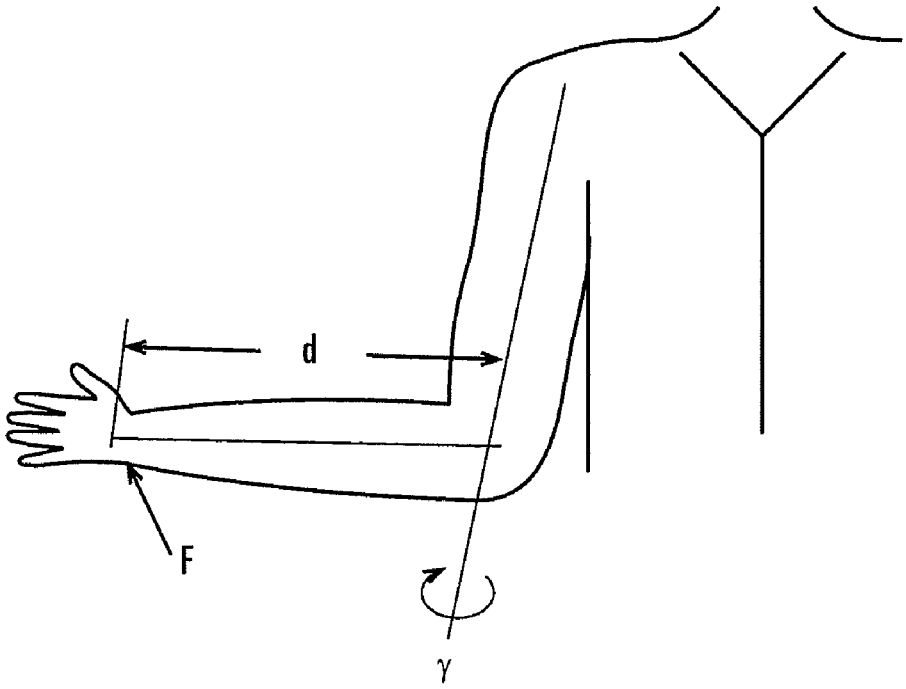

FIGS. 29A and 29B are illustrative drawings illustrating the variable elbow extension concept. FIG. 29A shows the forearm in a forwardly oriented position, and FIG. 29B shows the forearm rotated such that it is generally sidewardly oriented.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

It should be understood that the following description will be done with respect to multiple embodiments, including a first and a second embodiment, as well as various options which may be included with either embodiment.

First Embodiment (FIGS. 1-16)

The discussion of the first embodiment of the invention will be discussed with reference to FIGS. 1-16.

Elements of First Embodiment
User 5
Chair 6
Rear Chair Rail 7
Front Chair Rail 8
Inventive Apparatus 10

Base 20
- Horizontal Transverse Member 21
- Horizontal Side Members 22
- Rear Feet 23
- Front Posts 24
- Front Post Flanges 25
- Forwardly Facing Slots 26
- Downwardly Facing Slots 27

Spine 30
- Adjustable Mounting Grip 31
- Adjustable Mounting Grip Handle 32

Main Frame 40
- Main horizontal member 41
- Vertical Side Members 42
- Secondary Horizontal Member 43
- Side Mounting Members 44
- Carriage Gripping Members 46

Carriage Gripping Member Head 46H

Arm Carriage 50
- Forearm Retention Subassembly 60
- T-Shaped Base Portion 61
- Arm Cradles 62
- Tape Mounting Flange 63
- Cylinder End Mounts 64
- Fixed Pivot Pin 65
- Elbow Subassembly 70
- L-Shaped Member 71
- Retaining Bracket 72
- Height Adjustment Lock Pin 73
- Upper Arm Retention Subassembly 80
- Upper Arm Post 81
- Upper Arm Post Hole 81H
- Cylinder Mount 82
- L-Shaped Shoulder Retaining Assembly 84 a.k.a. anti-scapular elevation pad
- Arm Carriage Mounting Member 86
- Fixed Pivot Pin 87
- Locating Pin 88 (sets height before fixing)
- Pivot Fixing Pin 89

Power Unit 90
- Vertical Main Column 92
- Main Column Height Locating Pin
- Vertical Reservoir Subcolumn
- Pivoting Pump Handle 95
- Power Cylinder 96
- Horizontal Mounting Bracket 97
- Working (attached via plumbing) Main Cylinder 98

Torso Retention Assembly 110
Plumbing 120
Tape Measure 130
Tape 131

Detailed Discussion of First Embodiment

General Construction

FIGS. 1 and 2 show a first embodiment of the apparatus 10, with FIG. 1 showing the apparatus 10 without an associated folding chair and FIG. 2 showing the apparatus 10 with an associated chair 9. The apparatus 9 includes a base 20, a spine 30, a main frame 40, an arm carriage 50, a power unit 90, a torso retaining assembly 110 (not shown in FIG. 1 or 2 but shown in FIG. 4), plumbing 120 (not shown in Fig. A), and a tape measure 130.

General Operation

The apparatus and method of using same is configured to provide patient control of joint range of motion and particularly relates to a apparatus for providing control of the range of motion of a human shoulder. Particularly, this joint range of motion includes abduction and external rotation of the shoulder for a human user.

The apparatus is configured to allow for manipulation of either the right or left shoulder of the user upon the completion of a first changeover technique, and allows for either abduction or external rotation of a particular shoulder upon completion of a second changeover technique.

FIG. 3 shows a user 5 demonstrating the apparatus 10 as it provides abduction to, in this instance, the right shoulder of the user 5. As may be seen through the progressing stages of use of the apparatus, the shoulder can be progressively abducted from proximate the "UP" position shown to proximate the "DOWN" position shown, within the range designated as "R".

Note particularly use of an L-shaped shoulder retaining assembly element 84, also known as a "anti-scapular elevation pad assembly" 84, which provides an acromial counterpoint by maintaining the shoulder in place preventing vertical elevation of the scapula during the abduction process. This element is part of and moves along with the arm carriage 50 as discussed in more detail elsewhere. However it should be understood that another embodiment includes the use of such an element 284 which is stationary although adjustable. As noted above either of these elements may also be referenced as including an "anti-scapular elevation pad".

In FIG. 3, the user 5 may be shown with his left hand positioned on a pivoting pump handle 95 of a power unit 90 (discussed in detail further in this application), and his right arm cradled in an arm carriage 50, discussed in detail later in this application. As will also be discussed later in this application, the positions of the arm carriage 50 and the power unit can be interchanged relative to the main frame of the apparatus 10.

FIG. 4 shows a user 5 (viewed from the rear of the apparatus), situated within the apparatus 10, with the user's right arm in the arm carriage 50, and the apparatus 10 providing external rotation to the user's right shoulder within a range "R". The movement of the apparatus from the position within range "R" is provided by use of a hydraulic cylinder 98, and the use of associated hydraulics discussed elsewhere in this application, which are powered by the power unit 90 (e.g. shown in FIG. 3). Briefly stated, the arm carriage 50, when in the mode of operation shown in FIG. 4, pivots about a substantially vertical pivot axis which is Axis B shown in FIG. 5.

FIG. 5 can be used to show the use of a single pivot-fixing pin 89, alternately positionable at two separate locations, in order to provide two differing pivoting configurations. When the pin 89 is at the position shown as 89', the apparatus is configured to provide abduction about axis "A". When the pin is positioned as shown in 89", the apparatus is configured to provide external rotation about axis "B".

In FIG. 5, three axes may be observed, with the "X" axis being a horizontal axis, generally directed "forward" relative to the normal sitting position. The "Z" axis is generally directed towards the "right" end of the user in the normal sitting position, and the "Y" axis is an axis substantially perpendicular to the other two aforementioned axes and is generally directed vertically "up". Reference back to these three axes will be made throughout this application.

Disassembled Views

FIG. 6 is a disassembled view of the apparatus 10, with the various subapparatuses shown spaced apart. Specifically, subappartuses 50 and 90 and 110 are shown spaced apart from the main portion of the apparatus. Subapparatus 50 is the arm carriage subapparatus, and is configured to accept the arm of a user. Subapparatus 90 is the power unit subapparatus 90, and is configured to convert mechanical energy from the user to hydraulic energy. Subapparatus 110 is a torso retaining assembly.

Base 20

FIG. 7 is a more detailed front view of the base 20 of the apparatus.

The base 20 includes a horizontal transverse member 21, a pair of horizontal side members 22, rear feet 23, front posts 24, and front post flanges 25 (not shown in FIG. 7 but shown in FIG. 1).

The horizontal transverse member 21 is, when the user is situated in the seat, positioned generally parallel to the Z axis referenced in FIG. 5.

The horizontal side members 22 are attached substantially rigidly to the ends of the horizontal transverse member 21. The horizontal side members 22 have longitudinal axis which are substantially parallel, and each of the horizontal side members has a medial portion attached substantially rigidly to corresponding outer ends of the horizontal transverse member 21. The longitudinal axes of the horizontal side members 22 are substantially parallel, and parallel to the X axis referenced in FIG. 5.

The rear feet 23 extend generally downwardly from the rear ends of corresponding horizontal side members 22, and are substantially rigidly attached relative to the horizontal side members 22. The longitudinal axes of these rear feet 23, which are substantially elongate, are substantially parallel to the Y axis referenced in FIG. 5.

The front posts 24 extend generally upwardly from the front ends of corresponding horizontal side members 22 such that they are substantially perpendicular to the horizontal side members. At the ends of these front posts 24 are positioned front post flanges 25, which support tape measures as needed, discussed in more detail later in this application.

Referring now also to FIGS. 8 and 9, each of the horizontal side members 22 includes one downwardly facing slot 27 and a forwardly facing slot 26. Reference is particularly made to FIG. 8, which is a detailed view showing one of two downwardly facing slots 27. Reference is made to FIG. 9, which is a detailed view showing one of two forwardly facing slots 26, which is located in a corresponding one of the horizontal side members 22. These slots 26 and 27 are configured to engage rails which are located within typical folding chairs 6 such as shown in the figures.

The forwardly facing slots 26 are configured to engage front chair rail 8 of the chair 6 whereas the downwardly facing slots 27 are configured to engage a rearwardly located chair rail 7. It may be understood that, when the apparatus is in its located position, these slots provide a configuration which allows for mechanical engagement of the apparatus 10 relative to the chair 6. Particularly, the weight of the apparatus 10 is borne by the rear chair rail 7, along with the rear feet 23.

Spine 30

Referencing again to FIG. 7, as may be seen a spine 30 extends rigidly upwardly from the middle of the horizontal transverse member 21. Referring now also to FIG. 11, the top of this spine 30 releasably grips a portion of the main frame 40 as discussed below, said releasable gripping allowing for lateral adjustment of the frame 40 relative to the supporting spine 30 thereof along the directions of the arrows. This allows for adjustment of the device to accommodate varying torso lengths.

Main Frame 40

FIG. 10 is a view of a portion of the apparatus 10, shown in partially disassembled view, showing particulars of the main frame 40. The main frame 40 includes a main 30 horizontal member 41, a secondary horizontal member 43, side-mounting members 44, and carriage gripping members 46.

The main horizontal member 41 is substantially elongate and is in its normal operating position substantially parallel to the "Z" axis of FIG. 5. The vertical side members are attached to each end of the main horizontal member 41, and have their longitudinal axes substantially co-parallel and likewise parallel to the "Y" axis shown in FIG. 5.

The secondary horizontal member 43 is rigidly attached relative to the vertical side members 42, and is substantially elongate, having a longitudinal axis substantially parallel to and above the longitudinal axis of main horizontal member 41.

It should be understood that main horizontal member 41, vertical side members 42, and secondary horizontal member 43 combine to form a substantially rectangular rigid framework.

Side mounting members 44 are substantially rigidly mounted to corresponding side members 42, although some adjustment is available between the members 44 and 42.

Two carriage-gripping members 46 are used in the preferred embodiment, with one carriage-gripping member 46 located in association with each of the side-mounting members 44. Referring also temporarily to FIG. 15, each carriage-gripping member 46 includes a carriage gripping member head 46H, and as discussed later in this application, allows for selective attachment and detachment of the arm carriage 50 and the power unit 90, relative to either of the side-mounting members 44 of the main frame 40.

As discussed elsewhere in this application, it may be understood that the arm carriage 50 and the power unit 90 may be "switched" to either side of the main frame 40, depending on which of the arms require therapy for the particular user.

FIG. 11 is a detailed view of the adjustable mounting grip 31 which is located at the top of the spine 30. It should be understood that each adjustable mounting grip 31 includes a corresponding adjustable mounting grip handle 32.

FIG. 11 shows a user's hand on one of the two adjustable mounting grip handles 32. It should be understood that manual adjustment of such handles, allows for lateral adjustment of the entire frame 40 relative to the spine 30, along the axis of the two-headed arrow. Such manual adjustment is desirable when adjusting the apparatus relative to a particular user, particularly when adjusting the apparatus between the external rotation therapy position and the abduction therapy position.

Arm Carriage Subassembly 50

FIG. 12 shows an isolated view of the arm carriage subassembly 50.

The arm carriage subassembly 50 includes a forearm retention subassembly 60, a elbow subassembly 70, and a upper arm retention subassembly 80. FIG. 12 shows these three subassemblies 60, 70, and 80.

The forearm retention subassembly 60 includes a T-shaped base portion 61, two arm cradles 62, a tape-mounting flange 63, two cylinder end mounts 64 (only one is used, depending on right-hand or left-hand operation during external rotation), and likewise includes a pivot fixing pin 89.

The upper arm retention subassembly 80 includes an upper arm post 81 (which defines an upper arm post hole 81H), a cylinder mount 82 (for abduction), an L-shaped "anti-scapular elevation pad assembly" 84, an arm carriage mounting member 86, and includes a fixed pivot pin 87 (see also FIG. 13). A locating pin 88 is also included, which is configured to set the height of the unit 50. Finally, a pivot fixing pin 89 is also included, which is shown as being attached relative to the arm carriage assembly 50 by use of a flexible cable, such that this pivot fixing pin 89 may be moved between two different holes as described later in this application.

FIG. 13 shows, through the use of dotted lines, the two different holes which this pivot fixing pin 89 may be used, for differing results. In one type of therapy (abduction), the pivot-fixing pin 89 is used in one hole, whereas in another type of therapy (external rotation), the pivot-fixing pin 89 is used in another hole. This FIG. 13 likewise shows the two-cylinder end mounts 64, which are used when external rotation is desired. It may be understood that one of these cylinder end mounts 64 is used "right hand" mode whereas the other cylinder end mount 64 is used in the "left hand" mode.

FIG. 14 shows indicia I which is located on the upper arm post 81. This FIG. 14 likewise shows hole 81H, which is defined by the upper arm post 81. It may be understood that this hole 81H is one of the two holes which the pivot fixing pin 89 is configured to be positioned. For example, when the pivot-fixing pin 89 is positioned within the hole 81H, the apparatus is configured to provide external rotation. However, when the pivot-fixing pin 89 is not positioned in the hole 81H, but instead is positioned within the hole located on the underneath of the apparatus as shown in FIG. 13, this provides the apparatus with a configuration, which allows for abduction.

Referring back momentarily to FIG. 5, pin position 89' shows the pivot-fixing pin 89 in the position, which fixes the arm carriage 50 in its configuration suitable for abduction. Position 89" shows the pivot-fixing pin 89 in the position, which fixes the arm carriage 50 in its configuration suitable for external rotation. FIG. 5 likewise shows the fixed pivot axis B, which provides a fixed pivoting location between the T-shaped based portion 61 and the elbow subassembly 70 in order to effect pivoting for external rotation. In comparison, as shown, in FIG. 5, fixed pivot pin axis A provides a fixed pivot location between the upper arm post 81 and the arm carriage mounting member 86.

FIG. 13 shows the two arm cradles 62 which are rigidly but adjustably mounted on the T-shaped based portion 61. Each of these arm cradles 62 can include associated strapping as needed for releasably securing the forearm of a user. It may be further understood that when in place the general longitudinal axis of the forearm of the user is substantially parallel to the forward portion of the T-shaped base portion 61 in the usual position. It may also be understood that when in place the longitudinal axis of the upper arm of the user is substantially parallel to the longitudinal axis of the elongate upper arm post 81.

Power Unit 90

Reference is made back generally to FIGS. 1-3, showing the power unit 90 relative to the main frame 40 of the apparatus. It may be understood that the power unit 90 is selectively detachable relative to the frame 40 of the apparatus. The power unit 90 includes a vertical main column 92, a main column height locating pin, a vertical reservoir subcolumn, a pivoting pump handle 95 (shown operated by the left arm of the user in FIGS. 1-3), a small cylinder 96 (a.k.a. "power" cylinder), a horizontal mounting bracket 97, and a main cylinder 98 (shown in a first position in FIG. 1 and in a second position in FIG. 2)

The vertical main column 92 (see FIG. 2) is configured to be mounted to either of the two side mounting members 44 (see FIG. 10), by use of the carriage gripping members 46 and the main column height locating pin, as discussed elsewhere in this application. The vertical reservoir subcolumn is configured to provide a reservoir for hydraulic fluid as discussed elsewhere in this application.

The pivoting pump handle 95 is pivotably attached relative to the vertical reservoir subcolumn 94. A small cylinder 96 (a.k.a. "power" cylinder) is positioned such that reciprocating pivoting of the pivoting pump handle 95 causes a pumping action to the cylinder 96. Through hydraulics as discussed elsewhere in this application, such pumping causes fluid pressurized within the cylinder 96 to be likewise to transfer pressure of fluid within the working main cylinder 98, such that work is done by the working main cylinder 98.

The vertical reservoir subcolumn is rigidly attached relative to the upper end of the vertical main column 92. Underneath the lower end of the vertical reservoir subcolumn 94 is mounted by the horizontal-mounting bracket 97. This horizontal-mounting bracket 97 also provides for support of a torso retaining assembly 110 as described later in this application.

Switchable Mounting Configuration

As noted above, the use of the side-mounting members 44 allow for the power unit and the arm carriage to be switched relative to the frame 40. Note that FIGS. 1 and 2 show the switchable concept with respect to positioning of the power unit 98.

Reference is now made to FIG. 15, which as may be understood, includes the use of a main column height locating pin 88, which provides for location of the two elements 86, 44, whereas the actual gripping is done by the use of the carriage gripping element 46. Also shown are illustrative markings shown thereon, with the dotted lines showing the shaft of the locating pin 88, as well as the shaft and head member of the carriage gripping element 46.

Torso Retaining Assembly 110

FIG. 4 shows the torso retaining assembly 110 positioned adjacent the front of the left shoulder of a user. The horizontal-mounting bracket 97 is used to support such an element. It should be understood that, if the power unit 90 is switched to the other side, likewise is the torso retaining assembly 110 switched to the other side of the horizontal-mounting bracket 97. This torso retaining assembly 110 may also be referenced as an "anti-opposite shoulder rotation assembly" 110, and is also included in the second embodiment of the invention, discussed in later detail as shown in FIG. 23 as element 301. Such elements 110, 310 are useful in limiting torso rotation during the external rotation process.

Plumbing 120

FIG. 16 shows a schematic-type drawing of said plumbing, which is but one of several options available. This one includes a valve arrangement which facilitates the use of an "extend" as well as a "retract" position for a manually movable switch, in which the user can manipulate the switch to the "extend" position such that pumping of the pump cylinder (e.g. power cylinder 96) causes extension of the main cylinder (e.g. working cylinder 98), and whereas the user can manipulate the switch to the "retract" position such that pumping of the pump cylinder (e.g. power cylinder 96) causes retraction of the main cylinder (e.g. working cylinder 98). An alternate version includes the use of springs or other suitable devices for a return feature, with pumping only being used to provide cylinder extension and the springs/etc used to provide retraction.

Tape Measure 130

FIG. 1 shows the front post flanges 25, located on either side of the seat of the chair.

FIG. 2 shows the tape measure 130, which is attached to one of the front post flanges 25. The tape 130 includes an extendable tape portion 131, which may be used to provide a general guide of the extent to which the element 50 is moved relative to the stationary elements.

Switchover to Abduction Mode

FIG. 13 is intended to illustrate a manner in which the abduction mode of the apparatus can be selected, should a "switch over" be desired from its external rotation mode. Depending on the positioning of the pin 89.

Insertion of a pivot-fixing pin 89 into the underneath of the arm carriage 50 is configured to provide the mechanism in its "abduction" mode.

Note that the "offset" nature of the frame during adduction allows for some pre-inclination of the arm carriage 50 prior to the abduction feature. It may be understood that this "offset" feature allows for alignment of the pivoting axis of the arm carriage 50 with the normal pivoting axis the shoulder during abduction.

Switchover to External Rotation Mode

FIG. 4. shows the apparatus in various stages of external rotation.

Adjustments

Arm Carriage Height

The overall height of the arm carriage is adjusted by use of the carriage-gripping member 46 in conjunction with the locating pin 88. The locating pin is removed, the carriage gripping member 46 is loosened, and adjustment between the side mounting member 44 and the arm carriage mounting member 86 is made, upon which the pin 88 is reinserted (into suitably aligned holes in the members 44, 86) and the carriage gripping member 46 is retightened.

Power Unit Height

Such adjustment, between members 92 and 94, is similar to the adjustment of the arm carriage as described above.

Upper Arm Length

Upper arm length adjustment is made by use of the height adjustment lock pin 73 in conjunction with the retaining bracket 72. The height adjustment lock pin 73 is removed, and adjustment between the upper arm post 81 and the L-shaped member 71. Once adjustment is made (by use of indicia I) the pin 73 is reinserted (into suitably aligned holes in the members 71, 81).

Torso Retention Member 110

Adjustment is done by loosening fixing hardware and moving as needed.

Discussion of Operation of First Embodiment

The following instructions describe the set-up and operation of (applicant) ERMI's shoulder machine for two (2) degrees of movement—external rotation and abduction. Reference will be made to each type of motion where there are differences, otherwise the set-up and operation of the shoulder machine is the same for each.

Set Up Instructions (to be done by Nurse or Technical Assistant)

- 1) Attach base to folding chair
- Open folding chair approximately three-quarters
- Rest horizontal base of mainframe over rear rung and slide forward to insert front notches onto front rung.
- Rotate tape measure supports outward to clear chair seat
- Continue opening chair until rear notches lock onto rear rung
- Position and lock upper portion of mainframe as follows:
  - External rotation—place frame in center position
  - Abduction—slide frame to full left position for right arm use and to full right position for left arm use.
- 2) Measure Patient with tool provided
- For external rotation, measure width between underarms (positions Small/Medium/Large
- For abduction
  - With patient properly seated in chair, measure glenohumeral joint height (positions 1 through 5)
  - With patient properly seated in chair, measure humeral length (positions 1 through 5)
- 3) Attach arm unit to main frame
- For external rotation, the glenohumeral joint height pin and the humeral length pin can be at any position (1 through 5) provided they are the same
- For abduction, the glenohumeral joint height pin and the humeral length pin must be at their respective positions as measured in step (2) above
- With height pin halfway through arm unit, slide arm unit onto head of carriage bolt, complete insertion of height pin into making hold in main frame, and tighten clamp with handle point down
- For external rotation
  - Insert lockout pin to prevent abduction movement
  - Position forearm support brackets
    - Rear bracket to support outside of forearm at elbow with strap toward front
    - Front bracket to support inside of forearm at wrist with strap toward rear
    - For abduction
      - Insert lockout pin to prevent external rotation
      - Position both forearm support brackets on inside of forearm with strap on rear bracket toward front
      - Place shoulder support bracket onto arm unit with center of bracket opposite pivot bolt of arm unit.
  - Attach tape measure from arm unit to bracket on mainframe at front of seat
- 4) Attach power unit to main frame
- With attaching pin halfway through power unit, slide power unit onto head of carriage bolt, complete insertion of pin into mating hole in main frame, and tighten clamp with handle point down
- Adjust height of pump and handle assembly to match height of glenohumeral joints (positions 1 through 5).
- For external rotation, install the anti-rotation device onto its bracket in the position as measured in step (2) above (small/medium/large)
- Attach the power cylinder rod clevis to the appropriate position to complete set-up. Extend or retract cylinder rod manually or with pump to insert pin.

Setup Instructions (e.g. for patient)

1) Attachment of base to the folding chair.

Operating Instructions

1. Sit in chair.
2. Place forearm onto support brackets with rear of elbow touching frame.
3. For abduction pull Velcro strap over forearm at bend in elbow to secure elbow in frame.
4. For external rotation slip opposite arm under the anti-rotation device.

For external rotation slip affected limb's forearm into the forearm cradle and secure with Velcro strap.

5. Place switch in stretch position.
6. Pump gently until position of comfortable pain is reached and hold for 0 to 5-minute intervals of stretch with the same amount of time spent not stretching in recovery.
7. Flip switch to relax position.
8. Pump or pull arm into position where the joint is not being stretched for thirty seconds to one minute.
9. This is repeated for a total of 15 minutes of stretch.

Note that various additions or variations may be added to this version without departing from the spirit and scope of the present invention. Some of these changes have been included in the Second Embodiment below:

1. Velcro and multiple thickness pads and/or bolts could be used to adjust the distance of the acromial counter rotation pad from the patient's acromion (top of shoulder).
2. The power unit 90 can be tilted forward at an angle to allow better access to the extend/retract switch.

3. The power unit 90 can have the manifold that sits on top of the fluid storage container.
4. The spine 30 can allow for height adjustment of Main Frame 40.
5. The Arm Carriage 50 can include adjustable height Arm Cradles 62 to allow for better positioning of the patient's forearm into the cradle. The patient's arm (shoulder to elbow) distance can vary and needs to be adjusted between the Spine and the Arm Cradle adjustments.

Second Embodiment (See FIGS. 17-29)

Reference is now made to FIGS. 17-29, which show a second embodiment apparatus 210 of the present invention. It may be understood that many of the same features are present between the two embodiments, and so a complete detailed discussion of the second embodiment will not be made to the extent it would include repetition; however there are certain differences:

The positioning of the power unit 290
The adjustability of the height of the arm cradles
The adjustability of the frame 240
The use of a stationary anti-scapular elevation pad 284
The adjustability of the anti-opposite shoulder rotation bar to accommodate for width as well as depth of the thorax.
The Scapular Anti-Retraction pad was added.
An increase in adjustability of the anti-scapular elevation pad 284 was increased.
Increased adjustability of arm cradle pads
Improved position of hydraulic switch FIG. 17 shows the apparatus 210 according to the second embodiment of the present invention, as viewed in a pictorial view from a position to the right and to the front of the apparatus. It may be seen that in this embodiment the arm carriage 250 happens to be mounted for left shoulder manipulation; the first embodiment was shown configured for right shoulder manipulation.

Note in FIG. 17 the use of a stationary shoulder retaining assembly 284, also known as a "anti-scapular elevation pad assembly" 284, which is fixed relative to the frame 240 of the apparatus 210, and does not move with the arm carriage 250 as in the first embodiment.

FIG. 18 shows a close-up view of the arm carriage 250, viewed from the left and slightly to the front of the overall apparatus. The arm carriage 250 is different than the arm carriage 25 of the first embodiment in that a vertically adjustable feature is included. The arm carriage 250 includes a cradle support bar 268 (which supports arm cradles, not shown in FIG. 18, but discussed elsewhere), and a vertical adjustment member 267, which is attached in a perpendicular manner to the cradle support bar 268. These two rigidly attached members 267, 268, are adjustably attach to the remainder of the arm carriage assembly 250. Such vertical adjustment is made by the use of two locking knobs, one of which is shown as 269.

FIG. 19 shows another close-up view of the arm carriage 250, viewed from the left and slightly to the rear of the overall apparatus. This view shows the cylinder end mounts 264 of the second embodiment, which are essentially the same in shape and function as those in the first embodiment.

FIGS. 18 and 19 both show the arm carriage 250 also including an upper arm post 281 and an arm carriage-mounting member 286. This configuration is slightly different from the first embodiment in that the arm carriage-mounting member 286 of the arm carriage 250 is mounted directly (but detachably) relative to the frame 240 of the apparatus 210. Likewise, the frame of the power unit 290 is detachably mounted directly (but detachably) relative to the frame 240 of the apparatus 210. This allows these two elements 250, 290, to be interchangeably mounted as in the first embodiment. The mounting of these two elements 250, 290, to the frame is done by the use of two locating pins, one for each element, which holds the respective element in place while hex head machine screws or the like are used to provide a more secure fix between the elements 250, 290, to the frame. It may be understood that this does not allow for ready vertical adjustment of the overall elements 250, 290, to the frame, but such adjustment is accomplished in other manners as discussed elsewhere.

It should be understood that the changeover from abduction to external rotation is essentially the same in the second embodiment as in the first embodiment; a pin is used to selectively fix one of the two pivot points.

FIG. 20 shows the apparatus 210 in its configuration for working abduction. As may be seen, the working main cylinder 298 used in the second embodiment, which is part of the power unit 290, is used in a manner similar to the first embodiment.

FIG. 21 shows the apparatus 210 in its configuration for external rotation. Again as may be seen, the working main cylinder 298 is used in the second embodiment in a manner similar to the first embodiment.

FIG. 22 shows the configuration of the power unit 290 of the second embodiment of the invention. As may be seen, this configuration is different than that of the first embodiment. The toggle switch 310 also has a new position. This power unit 290 includes a substantially horizontal frame member 299 which is configured to support the anti-rotation attachment as discussed elsewhere in this application.

A portion of the frame 240, including an anti-scapular retraction pad 285, is likewise shown in FIG. 22. The anti-scapular retraction pad 285 is part of an assembly which includes a rigid metal plate which extends across the width of the upper portion of the frame 240 and is attached to the two vertical members of the frame. The metal plate supports the pad 285. This member is shown in at least FIGS. 17, 20, 22 and 26. The anti-scapular retraction pad 285 is configured to be positioned behind the shoulder blades of the user, and to discourage movement of the scapula of the user in a rearward direction from the standpoint of the user. This element 285 works in cooperation with the anti-opposite shoulder rotation pad member 301 during the external rotation process. Particularly, the anti-scapular retraction pad 285 is positioned behind the patient such that the pad contacts the posterior scapula of each shoulder such that when the arm is externally rotated the scapula is prevented from retracting. This prevents the external rotation developed by the apparatus from occurring at the capulothoracic joint as opposed to the glenohumeral joint.

FIG. 23 shows an anti-opposite shoulder rotation assembly 300 (also known as an opposite shoulder anti-rotation assembly) used in the second embodiment of the invention. The base of the anti-opposite shoulder rotation assembly 300 slides back and forth on Teflon or other suitable bearings on the frame member 299 of the power unit 290. Such adjustment makes it possible to adjust for chest depth. An elongage secondary bar is slidably mounted to the base and supports the padded restriction member 301 (also known as an anti-opposite shoulder rotation pad member 301), which contacts the body of the user. The secondary bar adjustably slides sideways so that it can accommodate patients with varying shoulder widths. The anti-opposite shoulder rotation pad assembly 300 tends to limit the user's ability to rotate the upper body when working on external rotation.

FIG. 24 shows the padded arm cradles 262, which have pins that fit holes in the cradle support bar 268 of the arm carriage 250. Depending on arm length the padded arm cradles 262 are placed in the appropriate position. In this figure one arm cradle is out of position to show the pins.

FIG. 25 shows the tape measure 230, which includes tape 231, similar to the configuration of the first embodiment. It may be seen that the tape measure 230 attaches to the chair and to the arm cradle. When the arm cradle is rotated away from the chair the distance is recorded on the tape measure 230 attached to the chair. This distance is a relative measure of progress of external rotation of the shoulder.

FIG. 26 shows a front elevational view of the spine 230, slidably and adjustably mounted relative to the frame 240. Adjustment arrows are also shown.

FIG. 27 is a close-up view of both the locking knobs for horizontal fixation, and the locking keys for vertical fixation. This is a view from the rear of the apparatus.

FIG. 28 is a close-up view of one of the locking keys for vertical fixation of the frame 240 relative to the spine 230. This is a view from the right and slightly to the front of the apparatus.

Referring now to FIGS. 26, 27, and 28, the frame 240 of the second embodiment apparatus can slide sideways (see arrow "S") to adjust for patient size and also to adjust settings when working on external rotation or abduction. The spine 230 is slidably and adjustably mounted relative to the frame 240, such that the combination of the frame 240, the spine 230 and the base (not shown in FIG. 26) can be compressed and this is the new way to adjust for height (see vertical arrow "H"). Since such height adjustment moves the frame up and down, both the height of the power unit and the height of the arm unit are adjusted at the same time. The gas cylinder facilitates lifting the structure since compressed gas helps push the structure up. Two locking keys or other suitable locking devices can be used to keep the structure in its desired position.

Variable Elbow Extension

It should be understood that a significant feature of the invention includes the provision of variable elbow extension during the external rotation process. This configuration develops force at the hand which develops a significant amount of torque at the shoulder. Reference is made to FIGS. 29A and 29B for discussion. FIGS. 29A and 29B are illustrative drawings illustrating the variable elbow extension concept.

Such variable elbow extension provides the elbow with approximately ninety (90) degrees of bend when the arm is in the initial position, but provides an additional amount (for example twenty (20) degrees) with the arm rotated in its full (approx) 65 degrees of external rotation to its extended position.

Such variable elbow extension is provided as follows. The arm of the user is positioned within the arm carriage, and the apparatus is adjusted so that the arm is positioned for suitable movement from its initial to its extended position throughout external rotation. Several adjustments can be made to the apparatus in order to position the forearm of the user at a horizontal orientation, including adjustments to the height of the arm carriage, and/or adjustments to the height or lateral position of the frame. As the pivot axis of the arm carriage is substantially vertical, it should thus be understood that the forearm of the user would remain at a horizontal orientation throughout external rotation. Said another way, the forearm will "sweep" within a horizontal plane during its movement. This is an important restriction as will be recognized below.

The above adjustments can also be made to provide proper positioning of the upper arm of the user, which is for the most part vertical, but inclined slightly out to the side of the user, for purposes of discussion approximately twenty degrees.

As noted above, the pivot axis of the arm carriage is substantially vertical, and under one embodiment of the invention, passes approximately through the elbow region. Under this configuration, the elbow remains substantially stationary (although it is being rotated) during the external rotation process. The upper arm likewise remains substantially stationary (although it is being rotated about its longitudinal axis) throughout the external rotation process.

Therefore it may be seen that when the arm of the user is moved from its initial position to its extended position, the elbow is manipulated from a bend angle of approximately 90 degrees to approximately 110 degrees, as the elbow tends to "open up" gradually as external rotation is performed, due to the fact that the forearm of the user is restricted to movement in a horizontal plane.

Furthermore, this apparatus allows for the elbow to extend slightly during the application of external rotation such that different parts of the elbow ligament complex "sees" the load at different positions of external rotation. The figure demonstrates the structures of the medial elbow including the medial ligament complex and the flexor bundle. These structures get stressed as load is placed at the hand creating an external rotation moment at the elbow and subsequently the shoulder. Different parts of these structures are stressed during load application depending upon the flexion/extension position of the elbow. In other words, the anterior portion of the medial ligament is more stressed with the elbow in extension while the posterior portion of the ligament is more stressed with the elbow in flexion. This change in position of the elbow during the stretching process protects the elbow by distributing the stress of the rotational moment across more fibers of the medial collateral ligament of the elbow and more structures of the medial side of the elbow, thus helping to prevent injury at the elbow secondary to the stretching process.

CONCLUSION

Many other modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An apparatus for manipulating the shoulder joint of the left or right arm of a human user, said apparatus comprising:

a frame including spaced apart first and second mounting locations;

an arm carriage configured to manipulate said shoulder joint of said user, said arm carriage configured to be mounted to one of said first and second mounting locations of said frame;

a power unit configured to provide power upon control by said user, said power unit configured to be mounted to the other of said first and second mounting locations of said frame;

a linkage intermediate said arm carriage and said power unit, said linkage configured to transfer power from said power unit to said arm carriage;

said arm carriage, said power unit, and said linkage configured to allow said arm carriage and said power unit to be switched between said first and second mounting locations and operated in alternating modes, such that in a first operating mode said arm carriage can manipulate the right arm of said user, and such that in a second operating mode said arm carriage can manipulate the left arm of said user.

2. The apparatus as claimed in claim 1, wherein said carriage is configured to be adjustably mounted along either said first or second mounting locations of said frame, to allow for customizable adjustments for different users.

3. The apparatus as claimed in claim 2, further comprising a seat to allow said user to be seated during said shoulder joint manipulation.

4. The apparatus as claimed in claim 1, wherein said frame is operably attached relative to a supporting seat structure, and wherein said frame is adjustable to allow for customizable positioning for said user.

5. The apparatus as claimed in claim 4, wherein said supporting seat structure is provided by a conventional folding chair.

6. The apparatus as claimed in claim 1, further comprising a tape measure attached intermediate said arm carriage and said frame to provide said user with a relative measurement for the purpose of identifying improvement during the stretching process.

7. The apparatus as claimed in claim 1, wherein said arm carriage includes two power unit attachment locations, either of which is configured to be attached to said power unit through said linkage, such that for a particular arm being manipulated, linkage of said power unit to one attachment location provides abduction of said particular arm upon control of said power unit by said user, and linkage of said power unit to the other location provides external rotation of said particular arm upon control of said power unit by said user.

8. The apparatus as claimed in claim 1, further comprising an anti-scapular elevation pad member fixed relative to said arm carriage and configured to be move along with said arm carriage when said arm carriage is switched between said first and second mounting locations, said anti-scapular elevation pad member configured to discourage the shoulder blade or scapula from elevating or abducting when said arm carriage is manipulating said shoulder joint of the left or right arm of said human user.

9. The apparatus as claimed in claim 8, further comprising an anti-opposite shoulder rotation member fixed relative to said power unit and configured to be move along with said power unit when said power unit is switched between said first and second mounting locations, said anti-opposite shoulder rotation member configured to discourage rotation of the shoulder of said user not being manipulated by said arm carriage.

10. The apparatus as claimed in claim 1, further comprising an anti-opposite shoulder rotation member fixed relative to said power unit and configured to be move along with said power unit when said power unit is switched between said first and second mounting locations, said anti-opposite shoulder rotation member configured to discourage rotation of the shoulder of said user not being manipulated by said arm carriage.

11. An apparatus for manipulating the arm of a user while seated in a substantially upright position, said arm including an upper arm and a forearm, said apparatus comprising:

a frame having a power unit mounting location;

a seat for a user to sit in such that said user can sit in said seat in said substantially upright sitting position while facing a direction substantially along a first axis, said axis being substantially horizontal;

an upper arm assembly pivotably mounted relative to said frame about a second axis, said second axis being substantially parallel to said first axis, said upper arm assembly also including an upper arm assembly power unit attachment location;

a forearm assembly pivotably mounted relative to said upper arm assembly about a third axis and configured to capture the forearm of the user during manipulation of the arm of the user, said third axis being substantially orthogonal to said second axis, said forearm assembly also including a forearm assembly power unit attachment location;

a power unit mounted to said frame at said power unit mounting location and including two opposing actuator ends capable of being moved alternately apart or together, said power unit configured to apply a linear force between said two actuator ends, said power unit further configured to have one of said actuator ends attached relative to said frame through the attachment of said power unit to said frame at said power unit mounting location, and to have the other of said actuator ends selectively attached to either said upper arm assembly power unit attachment location or to said forearm assembly power unit attachment location, such that when said other of said power unit actuator ends is selectively attached to said upper arm assembly power unit attachment location, application of said linear force by said power unit causes said upper arm assembly to pivot relative to said frame, and when said other of said power unit actuator ends is selectively attached to said forearm assembly power unit attachment location, application of said linear force by said power unit causes said forearm assembly to pivot relative to said upper arm assembly and to said frame; and at least one locking mechanism configured to discourage pivoting of said forearm assembly relative to said upper arm assembly when said other of said power unit actuator ends is attached to said upper arm assembly power unit attachment location and further configured to discourage pivoting of said upper arm assembly relative to said frame when said other of said power unit actuator ends is attached to said forearm assembly power unit attachment location.

12. The apparatus of claim 11, wherein said power unit employs pressurized fluid to create the linear force.

13. The apparatus of claim 11, wherein said apparatus includes two locking mechanisms, one associated with selectively locking said upper arm assembly relative to said frame, and the other associated with selectively locking said forearm assembly relative to said upper arm assembly with a pivot fixing pin being used with in association with at least one of said locking mechanisms.

14. The apparatus of claim 11, wherein said user includes two arms, and wherein said power unit mounting location of said frame is a first power unit mounting location and wherein said frame further includes a second power unit mounting location, and wherein both said mounting members can also serve as spaced apart first and second arm carriage mounting locations, wherein said upper arm assembly and said forearm assembly combine to form an arm carriage that is configured to manipulate the shoulder joint of the user, wherein said arm carriage is configured to be mounted to either said first or second arm carriage mounting locations of said frame, wherein said power unit is configured to provide power upon control by said user and is configured to be mounted to the other of said first or second arm carriage mounting locations of said frame, and said apparatus further comprising:

a linkage intermediate said arm carriage and said power unit, said linkage configured to transfer power from said power unit to said arm carriage, said arm carriage, said power unit, and said linkage configured to allow said arm carriage and said power unit to be switched between said first and second arm carriage mounting locations and to be operated in alternating modes, such that in a first operating mode said arm carriage can manipulate the right arm of the user, and such that in a second operating mode said arm carriage can manipulate the left arm of the user.

15. The apparatus for manipulating the arm of a user as claimed in claim 11, wherein said forearm assembly is configured to remain below the vertical plane including said second axis during said pivoting of said forearm assembly about said third axis.

16. The apparatus for manipulating the arm of a user as claimed in claim 11, wherein said locking mechanism includes a single pivot fixing pin which can alternately be moved from between two positions, a first position, in which to discourage pivoting of said forearm assembly relative to said upper arm assembly, to a second position, to discourage pivoting of said upper arm assembly relative to said frame.

17. An apparatus for manipulating the shoulder joint of a human user, said apparatus comprising:

a frame including spaced apart first and second mounting locations;

an arm carriage configured to manipulate said shoulder joint of said user, said arm carriage configured to be mounted to one of said first and said second mounting locations of said frame; and a power unit configured to provide power upon control by said user, said power unit configured to be mounted to the other of said first and said second mounting locations of said frame, said power unit including opposing first and second power unit actuator ends capable of being moved alternately apart or together, said power unit configured to apply a linear force between said first and second power unit actuator ends, said power unit further configured to connect the first of said power unit actuator ends at a first location relative to said frame while said power unit is attached at said first mounting location of said frame, and further configured to connect said first of said power unit actuator ends at a second location relative to said frame while said power unit is attached at said second mounting location of said frame, said arm carriage, said power unit, and said frame configured to be selectively connected together to allow said arm carriage and said power unit to be switched between said first and second mounting locations and operated in alternating first and second modes, such that in said first operating mode said power unit is attached to said frame at said first mounting location, and said second power unit actuator end is attached to said arm carriage such that said power unit and said arm carriage can manipulate the right arm of said user, and such that in said second operating mode said power unit is attached to said frame at said second mounting location, and said second power unit actuator end is attached to said arm carriage such that said power unit and said arm carriage can manipulate the left arm of said user.

18. The apparatus as claimed in claim 17, wherein said power unit includes a manual pump handle which is placed into different fixed pivoting positions depending on whether the power unit is mounted at said first or second mounting location, and wherein power to said power unit is controlled by the left hand of said user operating said manual pump handle in said first operating mode, and wherein power to said power unit is controlled be the right hand of said user operating said same manual pump handle in said second operating mode.

19. The apparatus as claimed in claim 17, further comprising an anti-scapular elevation pad member fixed relative to said arm carriage and configured to be move along with said arm carriage when said arm carriage is switched between said first and second mounting locations, said anti-scapular elevation pad member configured to discourage the shoulder blade or scapula from elevating or abducting when said arm carriage is manipulating said shoulder joint of the left or right arm of said human user.

20. The apparatus as claimed in claim 19, further comprising an anti-opposite shoulder rotation member fixed relative to said power unit and configured to be move along with said power unit when said power unit is switched between said first and second mounting locations, said anti-opposite shoulder rotation member configured to discourage rotation of the shoulder of said user not being manipulated by said arm carriage.

21. The apparatus as claimed in claim 17, further comprising an anti-opposite shoulder rotation member fixed relative to said power unit and configured to be move along with said power unit when said power unit is switched between said first and second mounting locations, said anti-opposite shoulder rotation member configured to discourage rotation of the shoulder of said user not being manipulated by said arm carriage.

22. A method of manipulating the shoulder of a user while seated in a substantially upright position, said user having an upper arm and a forearm, said method comprising the steps of:

A) providing an apparatus itself comprising:

1) a frame;

2) a seat for a user to sit in such that said user can sit in said seat in said substantially upright sitting position while facing a direction substantially along a first axis, said axis being substantially horizontal;

3) an upper arm assembly pivotably mounted relative to said frame about a second axis, said second axis being substantially parallel to said first axis; and 4) a forearm assembly pivotably mounted relative to said upper arm assembly about a third axis and configured to capture the forearm of the user during manipulation of the arm of the user, said third axis being substantially orthogonal to said second axis;

B) securing the forearm of a user to said forearm assembly;

C) selectively discouraging relative movement of said forearm assembly with respect to said upper arm assembly while at the same time allowing said upper arm assembly and said forearm assembly to both pivot together relative to said frame about said second axis;

D) pivoting said upper arm assembly about said second axis relative to said frame while at the same time said relative movement of said forearm assembly with respect to said upper arm assembly is discouraged such that abduction/adduction of the shoulder is created;

E) selectively discouraging relative movement of said upper arm assembly with respect to said frame while at the same time allowing relative movement of said forearm assembly relative to said upper arm assembly and said frame about said third axis; and F) pivoting said forearm assembly about said third axis with respect to said upper arm assembly and with respect to said frame while at the same time said relative movement of said upper arm assembly with respect to said frame is discouraged such that external rotation is created at said shoulder.

* * * * *